US006378277B1

(12) United States Patent
Inoue et al.

(10) Patent No.: US 6,378,277 B1
(45) Date of Patent: Apr. 30, 2002

(54) VERTICAL SEALING DEVICE FOR VERTICAL TYPE FORMING, FILLING AND CLOSING MACHINE FOR FLEXIBLE PACKAGES

(75) Inventors: Tatsuo Inoue; Eiji Yoshida; Naohiko Kakutani, all of Nagareyama (JP)

(73) Assignee: Tokyo Automatic Machinery Works, Ltd., Tokyo (JP)

( * ) Notice: Subject to any disclaimer, the term of this patent is extended or adjusted under 35 U.S.C. 154(b) by 0 days.

(21) Appl. No.: 09/438,960

(22) Filed: Nov. 12, 1999

(30) Foreign Application Priority Data

Dec. 16, 1998 (JP) ..... 10-358172
Jun. 28, 1999 (JP) ..... 11-182259

(51) Int. Cl.[7] ..... B65B 9/20; B65B 57/04
(52) U.S. Cl. ..... 53/614; 53/73; 53/551
(58) Field of Search ..... 53/64, 73, 551, 53/552, 502

(56) References Cited

U.S. PATENT DOCUMENTS 4,128,985 A * 12/1978 Simmons ..... 53/64
4,800,707 A * 1/1989 Rabus ..... 53/64
4,955,176 A * 9/1990 Seko ..... 53/73
5,743,066 A * 4/1998 Fukuda ..... 53/64

FOREIGN PATENT DOCUMENTS

JP B2-575616 10/1993
JP A9-58623 3/1997

* cited by examiner

*Primary Examiner*—John Sipos
(74) *Attorney, Agent, or Firm*—Birch, Stewart, Kolasch & Birch, LLP

(57) ABSTRACT

A vertical sealing device for a packing machine includes a pair of feed units for feeding a cylindrical-formed packaging material and a center heat sealer for the heat-sealing of a vertical seam of the packaging material. When the operation of the machine is halted, the feed units feed the packaging material from a steady speed mode to a deceleration mode. During this deceleration mode, the operation of the center heat sealer is stopped. On the other hand, when the operation of the packing machine is restarted, the feed units feed the packaging material in an acceleration mode, and during this acceleration mode, the center heat sealer starts operating.

8 Claims, 28 Drawing Sheets

VERTICAL SEALING DEVICE FOR VERTICAL TYPE FORMING, FILLING AND CLOSING MACHINE FOR FLEXIBLE PACKAGES

BACKGROUND OF THE INVENTION

1. Field of the Invention

The present invention relates to a vertical sealing device for a vertical type forming, filling and closing machine for flexible packages, and more particularly, to a vertical sealing device for appropriately controlling the timing of starting or halting a vertical sealing, i.e., center sealing of a cylindrical packaging material when the operation of the packing machine is stopped or restarted.

2. Description of the Related Art

As disclosed in, e.g., Japanese Patent Application Laid-open No.H9-58623 and Japanese Patent Publication No.H5-75616, the above-described type vertical sealing devices include a feed unit of a packaging material and a center heat sealer of the packaging material, and the operation and halting of the feed unit and the center heat sealer are electrically controlled.

The operation of the packing machine is maintained as long as the filling operation of articles into the packaging material is repeated at constant intervals. However, when there are not articles to be filled or the filing of the articles is failed, the operation of the packing machine is stopped. Thereafter, if the filling operation of articles is normally carried out, the operation of the packing machine is also restarted.

Even during a period of transition of the operation of the packing machine when the operation thereof is stopped or restarted, it is necessary to optimally control the feeding operation and the vertical sealing operation of the packaging material in order to prevent defective packaged products from producing. For this reason, both the sealing devices employ an unique control system for the feeding and center sealing of the packaging material during the period of transition of the operation of the packing machine.

In the case of the former sealing device (Japanese Patent Application Laid-open No.H9-58623), the operation of the packing machine is shifted to a transition period, one of the feed unit and the center heat sealer receives a halting signal or an operation signal therefor and then, the other of the feed unit and the center heat sealer receives a halting signal or an operation signal therefor after a predetermined delay time is elapsed therefrom. More specifically, when the operation of the packing machine is stopped, a halting signal is supplied to the feed unit first and then, after the feeding operation of the packing material by the feed unit is completely stopped, a halting signal is supplied to the center heat sealer. Therefore, until the packing material is completely stopped, the seam of superposed opposite side edges of the packing material is subjected to heat seal by the center heat sealer. On the other hand, when the operation of the packing machine is restarted, an operation signal is supplied to the center heat sealer, and after the heat seal of the seam is substantially restarted by the center heat sealer, an operation signal is supplied to the feed unit. Therefore, the seam of the packing material has already been subjected to the heat seal before the feed unit substantially feeds the packing material.

According to the above-described delay control, when the packing machine is stopped or restarted, the seam of the packing material can be subjected to the heat seal for sufficient time by the center heat sealer. Therefore, a portion of the seam of the packing material should not be insufficiently heated, i.e., faulty melting should not be occurred. As a result, it is possible to reliably carry out the center sealing with respect to the articles packed with packaging material.

The latter sealing device (Japanese Patent Publication No.H5-75616) employs a control system concerning the operation of the center heat sealer in which response delay is taken into consideration. More specifically, waiting time in which feeding operation of the packaging material by the feed unit is substantially at rest and response delay time required ON (close) and OFF (open) operation of the center heat sealer are compared with each other. If the response delay time is shorter than the waiting time, the OFF/ON operation of the center heat sealer is permitted. On the other hand, if the response delay time is longer than the waiting time, the OFF/ON operation of the center heat sealer is inhibited, and the center heat sealer is maintained in its ON state.

According to the latter sealing device, the OFF/ON operation of the center heat sealer is automatically controlled in accordance with the waiting time, i.e., the halting time. When the feeding operation of the packaging material is in a rest state for a long time, therefor, the center heat sealer should not be maintained in its ON state, and the seam should not be excessively heated, melted and ruptured.

However, in the case of the former sealing device, although fusion adhesion shortage of the seam of the packaging material can be avoided, a portion of the seam is heated twice by the center heat sealer, and excessive fusion adhesion of the seam is brought about. Such an excessive fusion adhesion disfigures the center seal, and degrades outer appearance quality of the packaged products.

Further, when the operation of the packing machine is stopped or restarted, it is desirable to decelerate or accelerate of the packaging material by the feed unit as gently as possible. If the packaging material is decelerated or accelerated gently, the center seal should not be wrinkled. However, gentle deceleration and acceleration increase the heating time of the seam of the packaging material, which brings about excessive fusion adhesion.

On the other hand, in the latter sealing device, if the above-mentioned waiting time of the packaging material is short, the center heat sealer is maintained in its ON operation. In this case, the deceleration and the acceleration of the packaging material increase the heating time of the seam of the packaging material, which also brings about excessive fusion adhesion.

SUMMARY OF THE INVENTION

It is an object of the present invention to provide a vertical sealing device for a packing machine, which does not bring about fusion adhesion shortage and excessive fusion adhesion in a center seal of a packaging material and which does not cause wrinkle in the center seal.

A vertical type packing machine with a vertical sealing device of the present invention includes a filling tube which guides a cylindrically formed packaging material and which is used for intermittently filling at least one article into the packaging material, the packaging material being formed such that both side edges thereof are superposed on each other so as to form a seam extending along the filling tube.

The vertical sealing device for achieving the above object comprises: a feed unit for feeding the packaging material along the filling tube, the feed unit including a constant mode for feeding the packaging material at a steady speed during a normally operating state of the packing machine, and a transition mode for feeding the packaging material at a speed other than the steady speed; a center heat sealer for heating and sealing the seam of the packaging material; and control means for controlling operation of the feed unit and the center heat sealer, the control means having a start timing for starting the operation of the center heat sealer, and a halt timing for halting the operation of the center heat sealer, and at least one of the start timing and halt timing being located in the transition mode of the feed unit.

According to the sealing device, the operation of the center heat sealer is halted after a predetermined time from the halt of operation of the feed unit when the operation of the packing machine is halted, or the center heat sealer is operated after a predetermined time from the start of operation of the feed units when the operation of the packing machine is restarted. Therefore, the seam of the packaging material should not be heated excessively or insufficiently, and it is possible to reliably prevent the fusion shortage or excessive fusion.

More specifically, the feed unit includes, as the transition mode, an acceleration mode for accelerating the packaging material from a halt state to the steady speed when the filling operation of the article into the packaging material is restarted from a halt state of the packing machine, and a deceleration mode for decelerating the packaging material from the steady speed to the halt state when a non-filling operation of the article occurs during the normally operation of the packing machine.

In this case, the control means has the start timing located in the acceleration mode, or has the halt timing located in the deceleration mode. More preferably, the control means may have he start timing and halt timing located in the acceleration and deceleration modes, respectively.

A period of time of each of the acceleration mode and the deceleration mode substantially may coincide with one packing cycle time required for forming one packaged products which contains the article during the steady operating state of the packing machine. In this case, the packaging material is gently accelerated and decelerated in the acceleration mode and the deceleration mode without largely lowering the packing ability of the packing machine. As a result, it is possible to effectively prevent wrinkles at the center seal.

Further, the feed unit may include, as the transition mode, temporary suspension regions in the acceleration mode and the deceleration mode, respectively. In this case, it is preferable that the packaging material is fed at the same speed in the temporary suspension regions.

If the feeding speed of the packaging material in the temporary suspension regions is the same, the control means can operate the feed unit continuously so as to directly shift the feeding state of the packaging material from the temporary suspension region in the deceleration mode to the temporary suspension region in the acceleration mode when a situation in which non-filling operation of the article does not occur continuously. In this case, the packing ability of the packing machine is not lowered substantially.

In such a state, the control means may have the start timing located after termination of the temporary suspension region in the acceleration mode, and may have the halt timing located within the temporary suspension region in the deceleration mode.

When no wrinkles at the center seal is more important than the packing ability of the packing machine, a period of time of the acceleration mode is set equal to or longer than the one packing cycle time, and a period of time of the deceleration mode is set equal to or shorter than the one packing cycle time.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
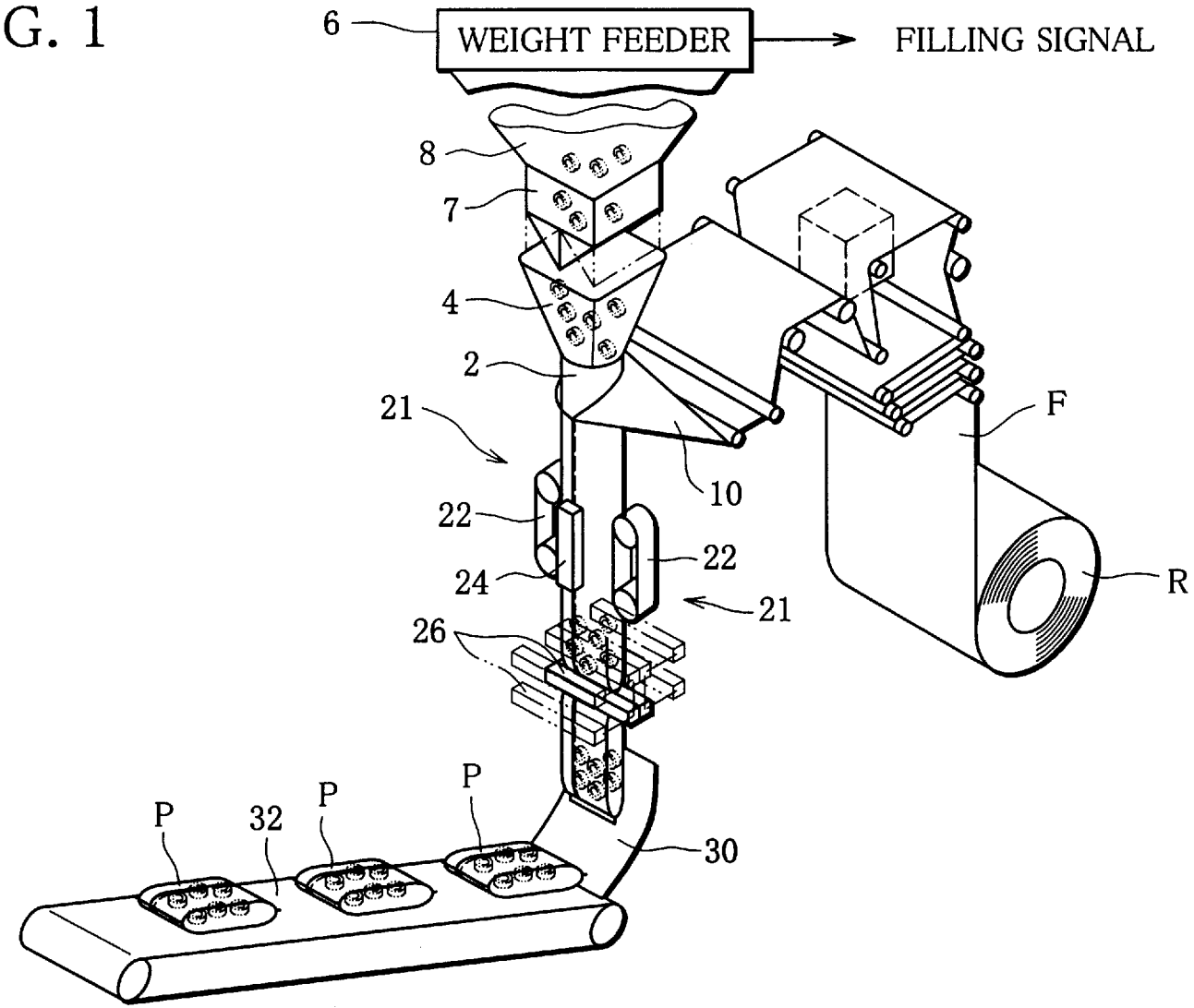
FIG. 1 is a schematic perspective view of a vertical type forming, filling and closing machine for flexible packaged products.

Referring to FIG. 1, a vertical type forming, filling and closing machine for flexible packages, that is, a packing machine includes a filling tube 2 which extends upward and downward. An upper end of the tube 2 is integrally connected to a lower hopper 4. The lower hopper 4 is connected to an upper hopper 8 through a shutter device 7. The upper hopper 8 is connected to a weight feeder 6 which accumulates therein a large number of articles in bulk. The weight feeder 6 feeds or drops the articles by a predetermined weight into the shutter device 7 through the upper hopper 8. When the shutter device 7 is opened, measured articles are dropped into the tube 2 through the lower hopper 4 from the shutter device 7. At that time, the weight feeder 6 receives an opening signal from the shutter device 7 and then outputs a filling signal. It is also possible to use a volumetric or counting feeder instead of the weight feeder 6.

The filling tube 2 is provided with a former 10, which surrounds the filling tube 2 at the underside of the lower hopper 4. The former 10 guides a packaging material F fed from a roll R toward the filling tube 2. Thereafter, the packaging material F is pulled down along the filling tube 2. The packaging material F is made of a film, which can be melted when heated. When the packaging material F passes through the former 10, the packaging material F is formed into a cylindrical shape which surrounds the tube 2. Then, both the side edges of the packaging material F pass through a lapping unit and are superposed on each other into a predetermined form.

Figure 2:
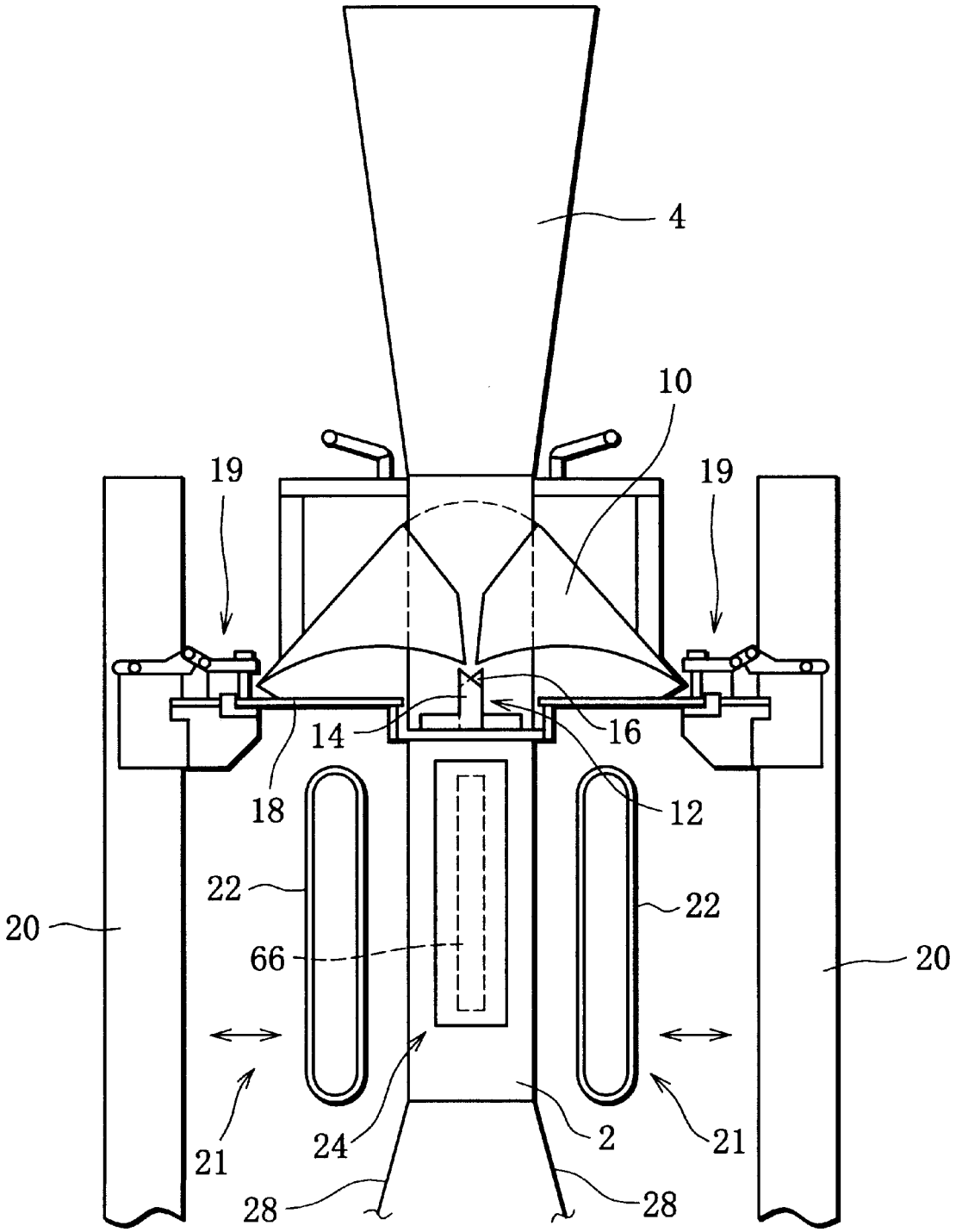
FIG. 2 is an enlarged front view of a portion of the machine shown in FIG. 1.

More specifically, the lapping unit 12 is disposed directly below the former 10 as shown in FIG. 2, and has a pair of guide plates 14 and 16. These guide plates 14 and 16 are arranged apart from an outer peripheral surface of the tube 2 by a predetermined distance, and define a guide passage therebetween. In the course of the passing of both the side edges of the packaging material F, the side edges are superposed on each other so as to form a seam. Concretely, the lapping unit 12 forms a seam aimed at fin seal or lap seal.

The above described tube 2, the former 10 and the lapping unit 12 are attached to a horizontal mounting board 18. The mounting board 18 is detachably mounted to a frame 20 of the packing machine through left and right supporting/locking mechanism 19. The tube 2, the former 10 and the lapping unit 12 are replacement parts which are replaced in accordance with a width of the packaging material F, i.e., packaged product to be produced.

The packing machine includes a vertical sealing device for the packing material F. The vertical sealing device has a pair of feed units 21 for feeding the packaging material F, and a center heat sealer 24. The feed units 21 are disposed on opposite sides of the filling tube 2. Since the pair of feed units 21 are symmetric with respect to the tube 2, a structure of one of the feed units 21 will be explained below.

Figure 3:
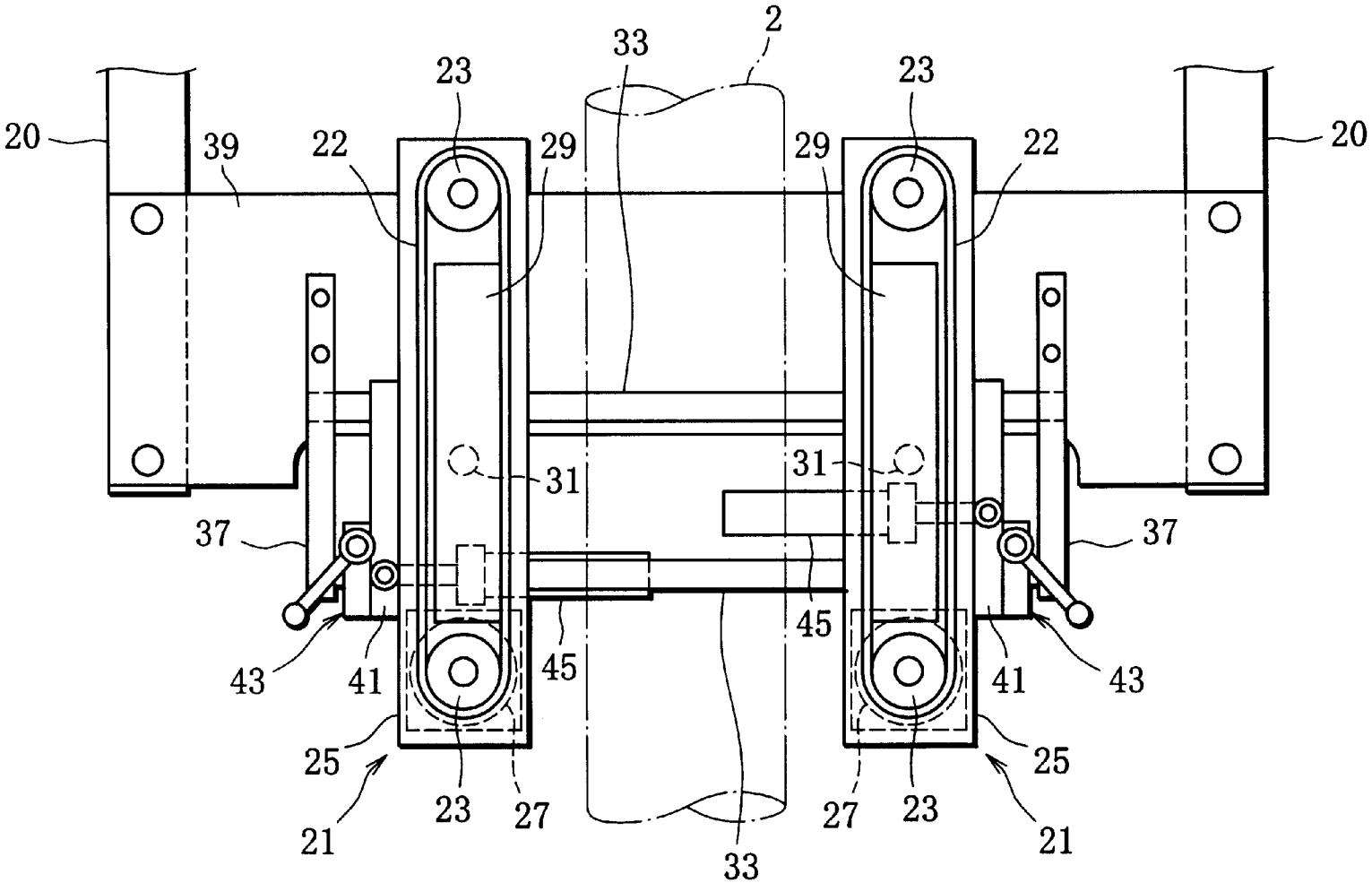
FIG. 3 is a detailed view showing the feed unit of a vertical sealing device of the machine of FIG. 1.

As shown in FIG. 3, the feed unit 21 includes an endless suction belt 22. The belt 22 extends upward and downward, and wound around upper and lower timing belt pulleys 23. Each of the pulleys 23 includes a pulley shaft which is rotatably supported by a base 25 of the feed unit 21. The pulley shaft of the lower pulley 23 is connected to an output shaft of a servomotor 27. When the servomotor 27 is driven, the suction belt 22 runs in one direction. The base 25 includes a suction box 29 which extends upward and downward between the upper and lower pulleys 23. The suction box 29 has a suction chamber (not shown) defined therein, a guide groove (not shown) formed on a side surface at the side of the filling tube 2, and a connection hole 31 formed in a rear surface at the side of the base 25. The connection hole 31 is connected to a negative pressure source through a suction hose, and the interior of the suction chamber is maintained at a predetermined negative pressure. In the drawing, the suction hole, the negative pressure source and an air pressure control circuit for them are omitted.

The guide groove extends along the belt 22 for guiding the running motion of the belt 22. The guide groove is provided at a bottom surface thereof with a large number of suction holes (not shown) which are in communication with the suction chamber. Therefore, the belt 22 in the guide groove can receive a predetermined suction force from the suction chamber.

The base 25 is slidably mounted to upper and lower horizontal guide rods 33. The guide rods 33 are supported at their opposite ends by side plates 37 which are mounted to a cross plate 39. The cross plate 39 extends horizontally, and opposite ends thereof are connected to the frame 20 of the packing machine.

The upper and lower guide rods 33 pass through movable stoppers 41. Each of the movable stoppers 41 is located between the corresponding side plate 37 and base 25 for sliding movement on the guide rods 33. The movable stoppers 41 includes a lock mechanism 43 which fixes the movable stopper 41 at arbitrary position on the guide rods 33.

The base 25 includes an air cylinder 45 which is horizontally mounted to a rear surface thereof. The air cylinder 45 has a piston rod which extends toward the corresponding movable stopper 41 and is connected to the movable stopper 41. If the piston rod of the air cylinder 45 extends from a state shown in FIG. 3, the corresponding feed unit 21, i.e., the belt 22 thereof moves toward the tube 2 and approaches the cylindrical packaging material F which surrounds the tube 2. In the approaching state of the belt 22, when the suction force is supplied to the belt 22, the belt 22 can suck the packaging material F. Further, when the belt 22 runs in this state, the packaging material F is fed downward along the tube together with the belt 22. With this feeding operation, the former 10 forms the flat packaging material F into the continuous cylindrical shape, and the lapping unit 12 forms both the side edges of the packaging material F into the continuous seam.

As shown in FIGS. 1 and 2, the center heat sealer 24 is disposed in the vicinity of the filling tube 2. In more detail, the center heat sealer 24 is located below the lapping unit 12. Therefore, the seam of the packaging material F passes through a space between the center heat sealer 24 and the tube 2 and at that time, the center heat sealer 24 melts and fuses the seam of the packaging material F into an united form by heating. That is, the side edges of the packaging material F are adhered to each other by the heat seal.

Figure 4:
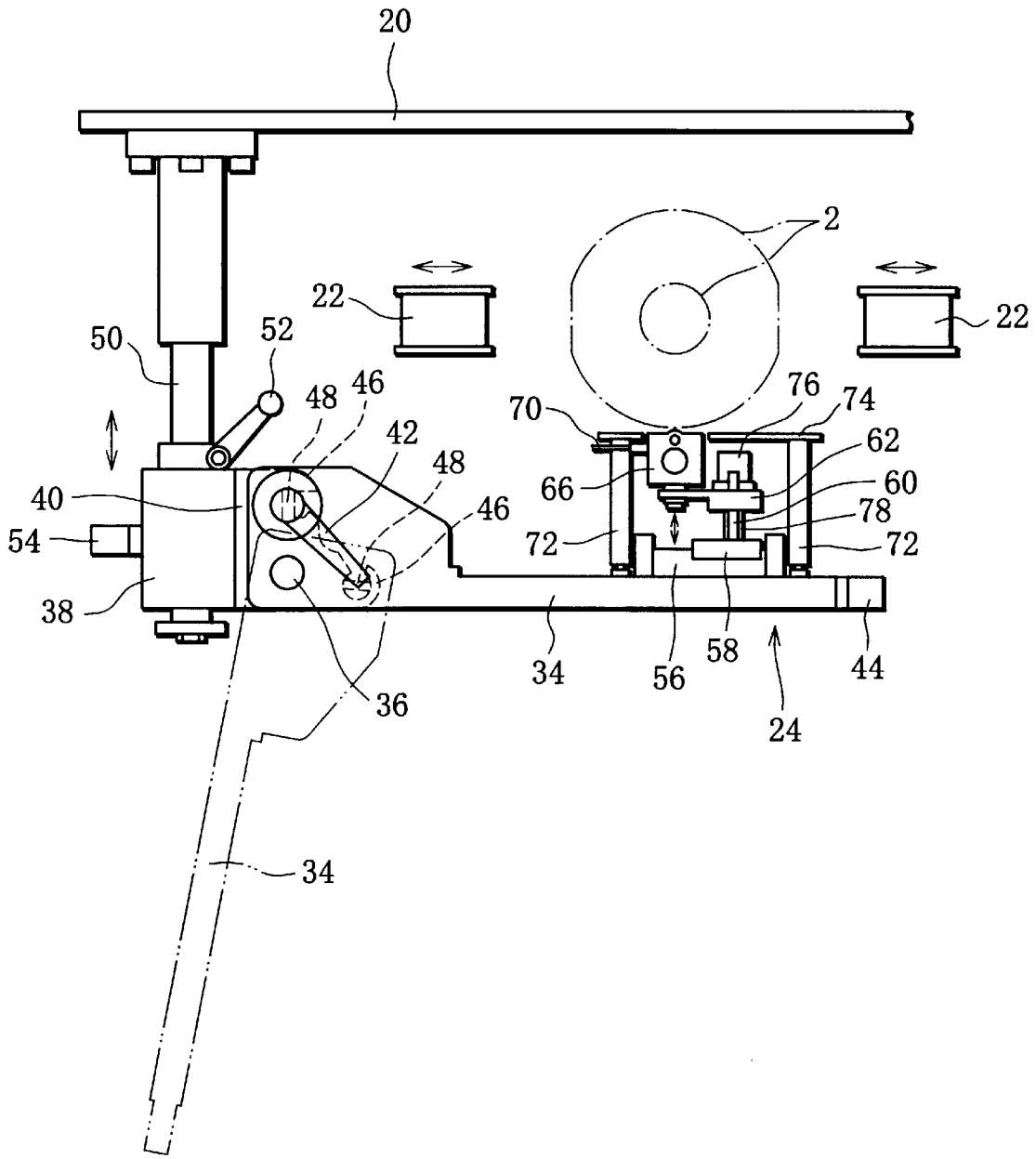
FIG. 4 is a plan view showing a center heat sealer of the vertical-sealing device.

As shown in FIG. 4, the center heat sealer 24 is mounted to a distal end of a supporting arm 34. The supporting arm 34 horizontally extends in front of the tube 2. A proximal end of the supporting arm 34 is connected to a slider 38 through a pivot shaft 36. In more detail, the slider 38 has a bracket 40, and the bracket 40 rotatably supports the pivot shaft 36. Therefore, the supporting arm 34 can rotate around the pivot shaft 36 in a horizontal plane.

Further, the supporting arm 34 houses a lock mechanism (not shown) in the proximal end thereof. The lock mechanism has a lock handle 42 which projects upward from the supporting arm 34. By operating the lock handle 42, the lock mechanism fastens the supporting arm 34 to the bracket 40 and releases the fastening of the supporting arm 34. Therefore, when the fastening of the supporting arm 34 is released, the supporting arm 34 can rotate between a closed position shown with a solid line and an opened position shown with a two-dot chain line. In order to facilitate the rotating motion of the supporting arm 34, the supporting arm 34 is provided at its distal end with a handle 44.

The bracket 40 further includes two hooks 46 respectively corresponding to the closed position and the opened position of the supporting arm 34. When the supporting arm 34 is in the closed position, the corresponding hook 46 receives a lock shaft 48 of the lock mechanism, thereby selectively fixing the supporting arm 34 to one of the closed position and the opened position thereof.

The slider 38 is slidably mounted to upper and lower guide rods 50. These guide rods 50 horizontally extend in a direction perpendicular to an axis of the filling tube 2, and proximal ends of the guide rods 50 are supported by the frame 20 of the packing machine. The slider 38 also houses a lock mechanism (not shown) having a lock handle 52. By operating the lock handle 52, the lock mechanism fastens the slider 38 to the guide rods 50 and releases the fastening of the slider 38.

When the fastening of the slider 38 is released, the slider 38 can slide on the guide rods 50. Such a sliding movement is allowed so as to adjust a distance between the supporting arm 34 and the tube 2 in the closed position in accordance with a diameter of the filling tube 2. In order to facilitate the sliding movement of the slider 34, the slider 34 also has a handle 54. In FIG. 4, the maximum diameter and the minimum diameter of the filling tube 2 are shown with one-dot chain lines respectively.

The distal end of the supporting arm 34 is provided at its inner surface with a bracket 56 which supports a plate 58. The plate 58 extends upward and downward along the filling tube 2, and has upper and lower guide rods 60. These guide rods 60 horizontally project from the plate 58 toward the tube 2. Each of the guide rods 60 slidably passes through a plate 62, and the plate 62 is opposed to the plate 58.

The plate 62 includes a heater block 66 and an air cylinder 76. The heater block 66 houses a heater therein and vertically extends in the axial direction of the tube 2. The air cylinder 76 is placed between the upper and lower guide rods 60 and has a piston rod 78. The piston rod 78 passes through the plate 62, and a distal end of the piston rod 78 is connected to the plate 58. In the drawing, a feeder circuit for the heater block 66 and a pneumatic circuit for the air cylinder 76 are omitted.

The filling tube 2 is provided at its outer surface with a packaging material guide or a seam guide (not shown). The seam guide is opposed to a tip end face of the heater block 66, and extends along the tube 2.

If the piston rod 78 of the air cylinder 76 is contracted from the state shown in FIG. 4, the plate 62 is moved together with the heater block 66 toward the plate 58 while being guided by the guide rods 60. Therefore, the heater block 66 moves away from the tube 2. On the other hand, if the piston rod 78 of the air cylinder 76 is extended, the heater block 66 advances toward the tube 2 and approaches the tube 2. In the approaching state with respect to the tube 2, the seam of the packaging material F is sandwiched between the tip end of the heater block 66 and the seam guide. In this state, if the heater block 66 has been heated to a predetermined temperature, and the seam of the packaging material F passes through the heater block 66, the heater block 66 satisfactorily heats and melts the seam. As a result, the heater block 66 continuously carries out the heat seal for the seam, thereby forming the center seal (vertical seal) in the packaging material F.

The supporting arm 34 further includes a plurality of guard rods 72. These guard rods 72 extend toward the filling tube 2 from the supporting arm 34, and are disposed such as to surround the heater block 66, the air cylinder 76 and the like. Distal ends of guard rods 72 support a guard plate 74. The guard rods 72 and the guard plate 74 prevent inadvertent access to the heater block 66. However, the guard plate 74 has an aperture for the heater block 66. The aperture allows the heater block 66 to approach the filling tube 2 and retreat from the tube 2.

As shown in FIG. 2, the filling tube 2 is provided at its lower end with a pair of fins 28. These fins 28 extend downward such as to gradually separate from each other from the lower end of the tube 2. Therefore, after the heat seal of the packaging material F, and the packaging material F comes out from the lower end of the tube 2, the fins 28 push and widen the material F in the lateral direction to form the packaging material F into a flat cylindrical shape.

As shown in FIG. 1 schematically, the packing machine further includes a top heat sealer 26 below the filler tube 2. The top heat sealer 26 is operated in association with the operation (feeding of the packaging material F) of the pair of feed units 21. Therefore, the packaging material F which has been subjected to the center seal is subjected to top seals at a predetermined intervals. Further, after the top seal, the top heat sealer 26 cuts the packaging material F from a center of a seal width of the top seal, and separates the packaging material F into individual packages.

The above-described top seal as well as cut operation, and feeding of the articles into the filling tube 2, i.e., into the packaging material F are carried out alternately and as a result, each of the packages becomes a packaged product in which the articles are fed.

Figure 5:
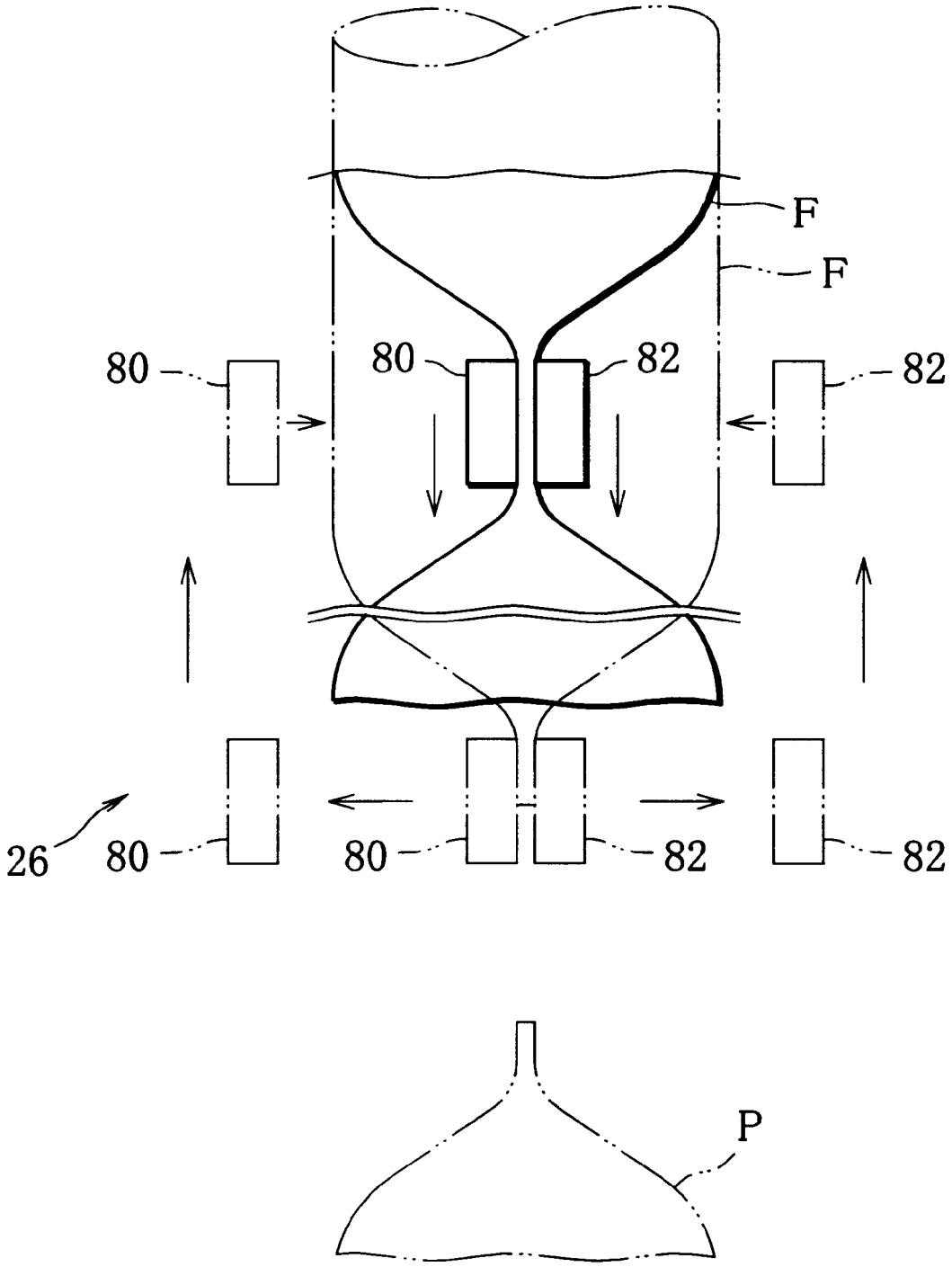
FIG. 5 is a view showing motion of a top heat sealer of the machine.

Referring to FIG. 5, movement of the top heat sealer 26 is shown more concretely. The top heat sealer 26 includes a heater block 80 and a receiving block 82, and these blocks 80 and 82 move upward and downward in association with feeding operation of the packaging material F, and close such as to approach each other and open such as to separate from each other. That is, the top heat sealer 26 can open or close simultaneously with rising or lowering movement. Therefore, when the top heat sealer 26 closes, the packaging material F is sandwiched between the blocks 80 and 82, and the top seal of the packaging material F is carried out. A movable blade (not shown) is embedded in one of the heater block 80 and the receiving block 82, and the other one of them includes a receiving groove (not shown) for the movable blade. When the top seal of the packaging material F is completed, the movable blade projects from one of the blocks into the receiving groove of the other block, thereby cutting the packaging material F.

As shown with a solid line in FIG. 5, when the top heat sealer 26 is in a closed state, the heater block 80 and the receiving block 82 approach each other to sandwich the packaging material F between them. At that time, the top heat sealer 26 is being lowered, and the lowering speed of the top heat sealer 26 is the same as the feeding speed of the packaging material F. In such a lowering process of the top heat sealer 26, the articles are fed into the packaging material F, and then the top seal of the packaging material F is carried out.

When the top heat sealer 26 reaches in the vicinity of its lower limit position, the movable blade projects toward the packaging material F and cuts the packaging material F at a center position of a seal width of the top seal. Thereafter, the top heat sealer 26 opens, that is, the heater block 80 and the receiving block 82 are separated from each other, the packaged product P (see FIG. 5) is released from the top heat sealer 26 and is dropped therefrom and then, the top heat sealer 26 rises toward its upper limit position. The top heat sealer 26 repeats the above-described action, thereby dropping individual packaged products P continuously.

The packaged product P dropped from the top heat sealer 26 is received by a chute 30 (see FIG. 1), and is supplied from the chute 30 to a belt conveyer 32. The belt conveyer 32 transfers the packaged products P toward a box-packing machine (not shown).

In order to control the operation of the vertical sealing device, i.e., the pair of feed units 21 and the center heat sealer 24, the packing machine comprises a controller 84. The controller 84 includes a microcomputer having a microprocessor, an input/output interface, memory devices such as RAM and ROM, and peripheral circuits.

Figure 6:
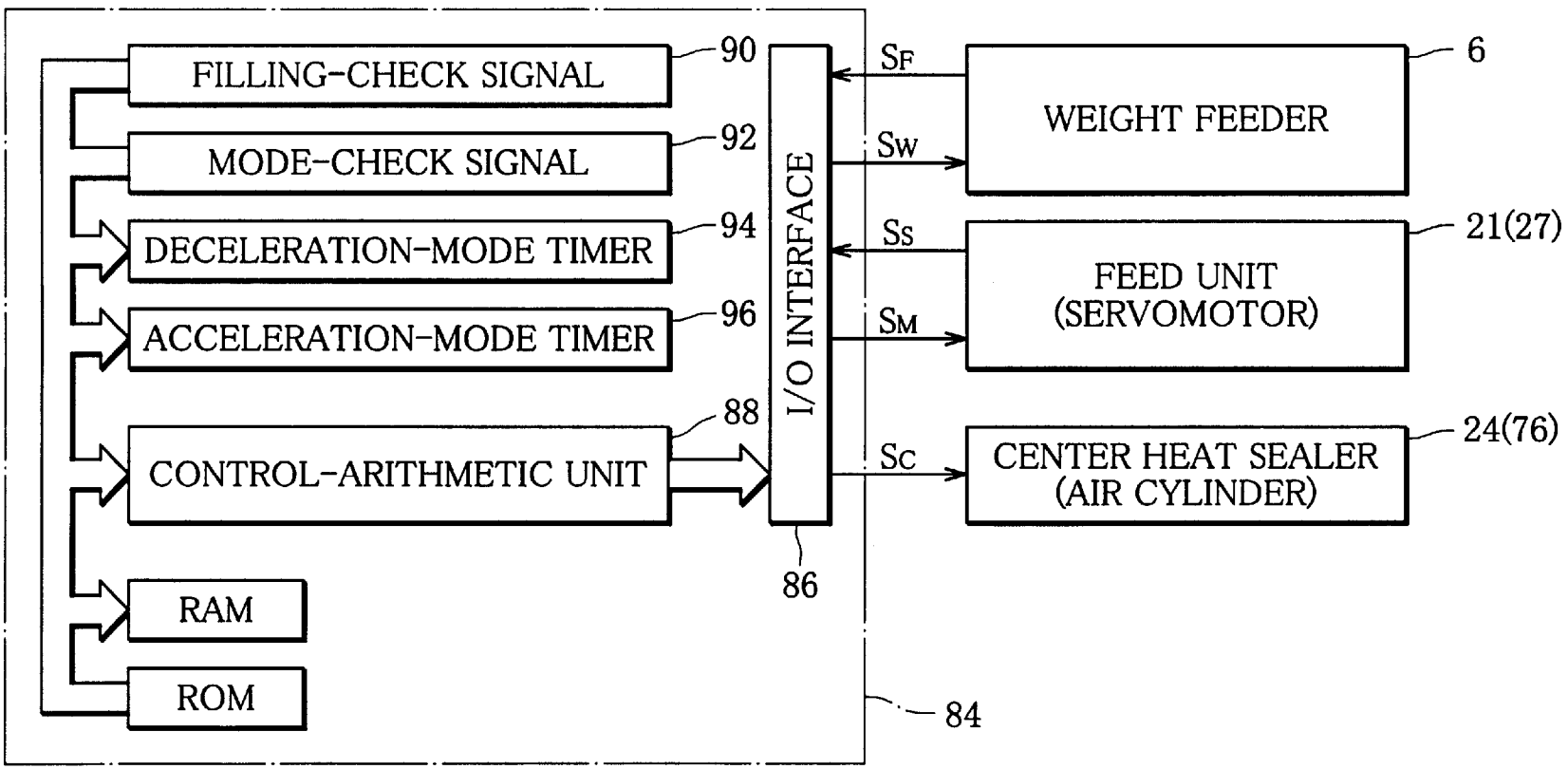
FIG. 6 is a schematic block diagram of a controller for a center seal control.

As shown in FIG. 6, the input/output interface 86 for the controller 84 is electrically connected to the pair of feed units 21 and the center heat sealer 24. The microprocessor can receive a filling signal $S_F$ from the weight feeder 6 through the input/output interface 86, and can output a waiting signal $S_W$ to the weight feeder 6. The microprocessor outputs control signals to the pair of feed units 21 through the input/output interface 86, and controls the supply of suction pressure to the suction belt 22, the driving of the servomotor 27 and the like based on these control signals. Only the driving signal $S_M$ is indicated as the control signal in FIG. 6, and the driving signal $S_M$ controls the driving of the servomotor 27 in the feed unit 21. On the other hand, the servomotor 27 outputs a halting signal $S_S$, and the halting signal $S_S$ is supplied to the microprocessor through the input/output interface 86.

Further, the microprocessor delivers control signals to the center heat sealer 24 through the input/output interface 86, and controls the electricity feeding to the heater of the heater block 66 and the change-over of a solenoid operated valve (not shown) which operates the air cylinder 76 based on the control signals. In FIG. 6, only a change-over signal $S_C$ for control the change-over of the solenoid operated valve is shown.

More specifically, in addition to a control-arithmetic unit 88 connected to the input/output interface 86, the microprocessor further includes a first generating section 90 for generating filling-check signals, a second generating section 92 for generating mode-check signals, a deceleration-mode timer 94 and an acceleration-mode timer 96. These generating sections 90 and 92 as well as the timers 94 and 96 are connected to the control-arithmetic unit 88.

The RAM and ROM are also electrically connected to the unit 88. The unit 88 reads control program for the center seal stored in the ROM and data such as initial values and the like stored in the RAM, and controls the weight feeder 6 and the vertical sealing device in accordance with the control program. At the time of such control, the unit 88 can temporarily store necessary data in the RAM.

The first generating section 90 generates a filling-check signal $S_{FC}$ at a constant cycle. If the weight feeder 6 is in a steady operating state, that is, the articles are fed from the weight feeder 6 into the tube 2 at constant time intervals and the weight feeder 6 output the filling signal $S_F$ at a constant intervals, the generating cycle of the filling-check signal $S_{FC}$ coincides with the output cycle $S_P$ of the filling signal $S_F$. Further, the generating timing of the filling-check signal $S_{FC}$ is determined within an output period of the filling signal $S_F$.

Figure 7:
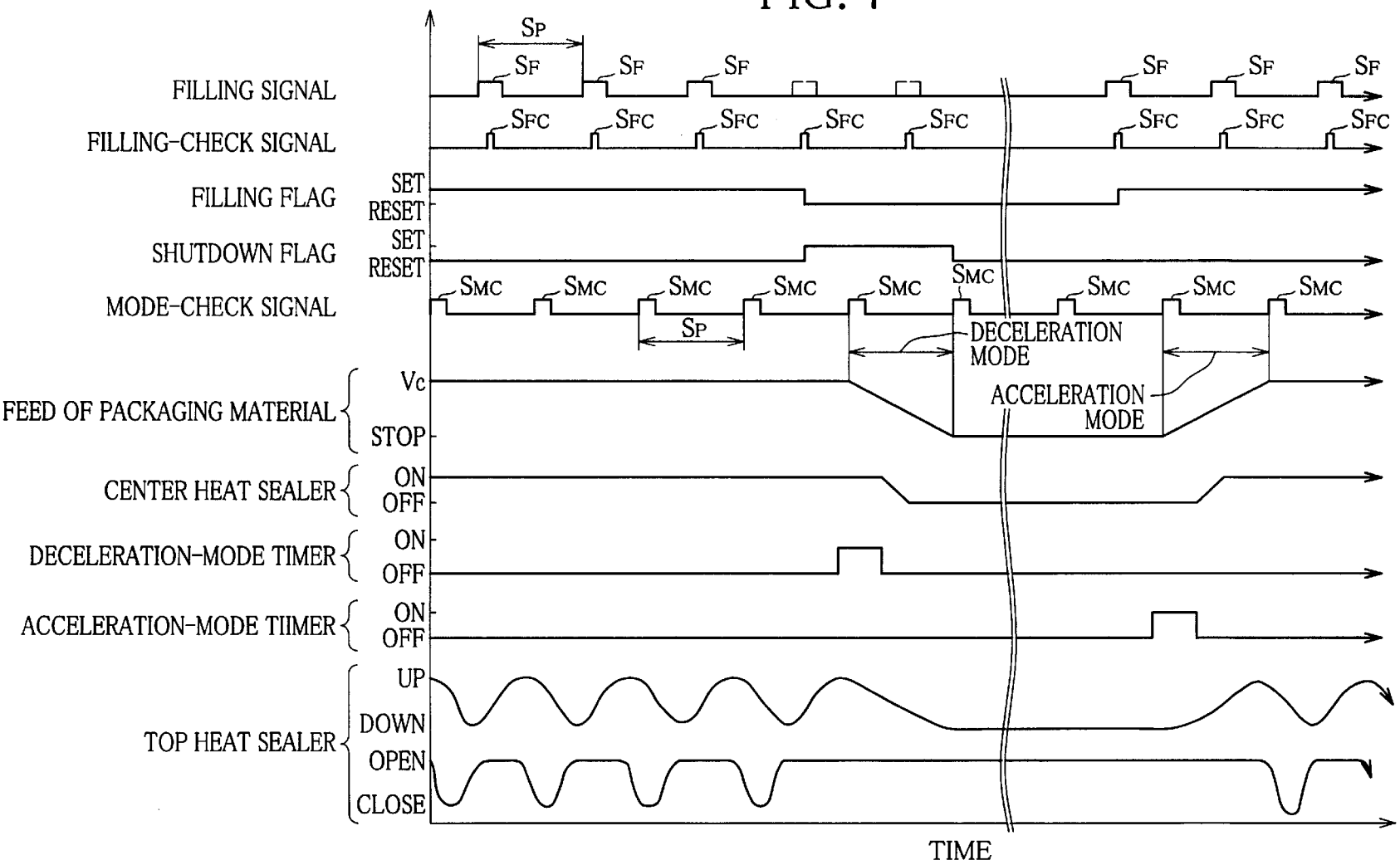
FIG. 7 is a timing chart showing a relation between a feeding state of a packaging material fed by the feed unit and ON/OFF operation of the center heat sealer.

As shown in FIG. 7, when the weight feeder 6 is in the steady operating state, the filling signals $S_F$ become pulse signals having a constant cycle, and the output cycle $S_P$ of the filling signals $S_F$ in this case coincides with one packaging cycle required for producing one packaged product P when the packing machine is in its steady operating state.

The second generating section 92 generates the mode-check signals $S_{MC}$ at the same cycle as the generating cycle of the filling-check signals $S_{FC}$, and the generating timing of the mode-check signals $S_{MC}$ is set between timings at which the filling-check signals $S_{FC}$ are generated. Therefore, the filling-check signal $S_{FC}$ and the mode-check signal $S_{MC}$ are alternately generated. Here, the generating cycle of the mode-check signal $S_{MC}$ coincides with the output cycle $S_P$ of the above-described filling signal $S_F$ when the weight feeder is in the steady operating state.

Figure 8:
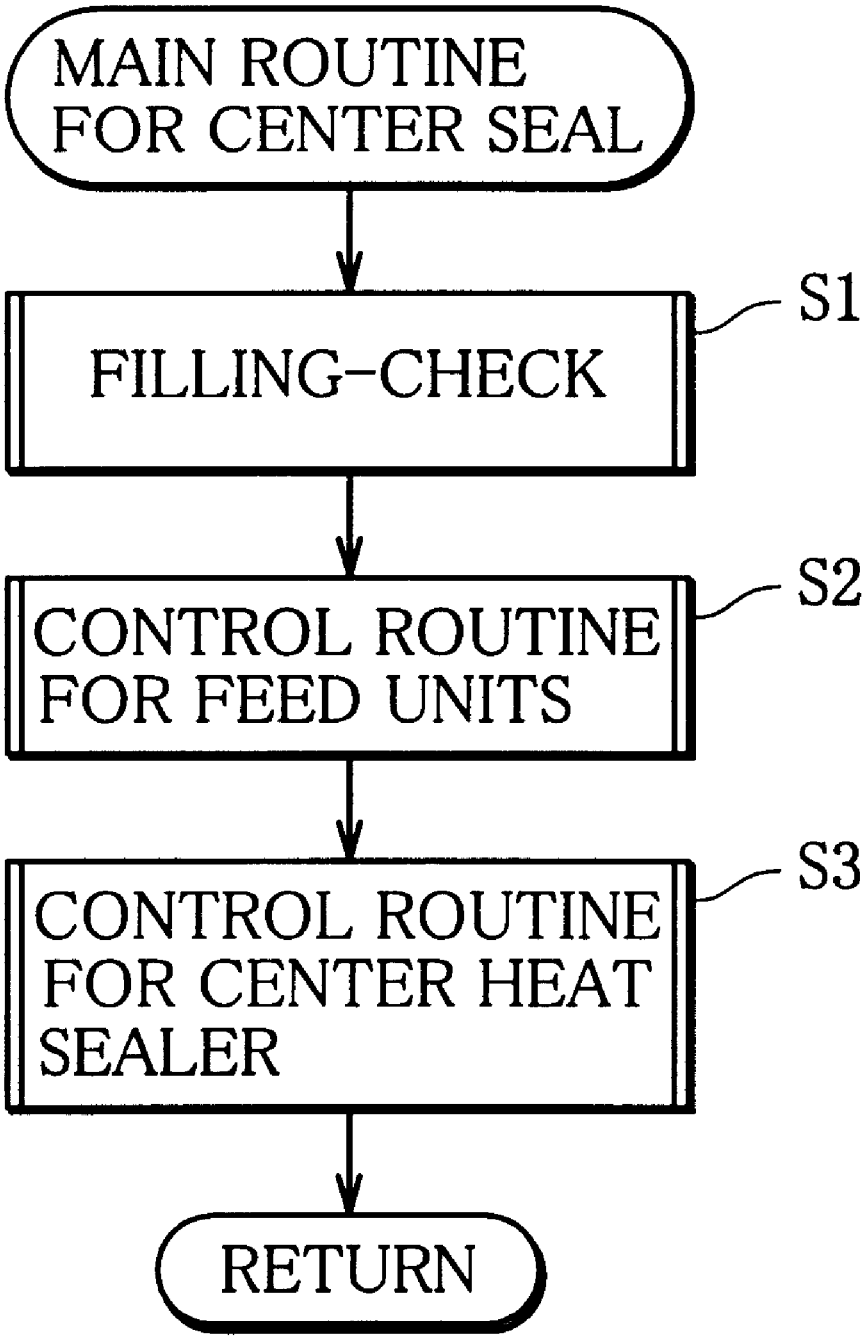
FIG. 8 is a flowchart showing a main routine for the center seal control.

When the packing machine is already operated, the control-arithmetic unit 88 of the controller 84 repeatedly carries out a main routine for the center seal shown in FIG. 8 in a predetermined control cycle. A control routine includes a check routine S1 for checking the filling operation of the articles, and control routines S2 and S3 for controlling operations of the feed units 21 and the center heat sealer 24.

Check Routine

Figure 9:
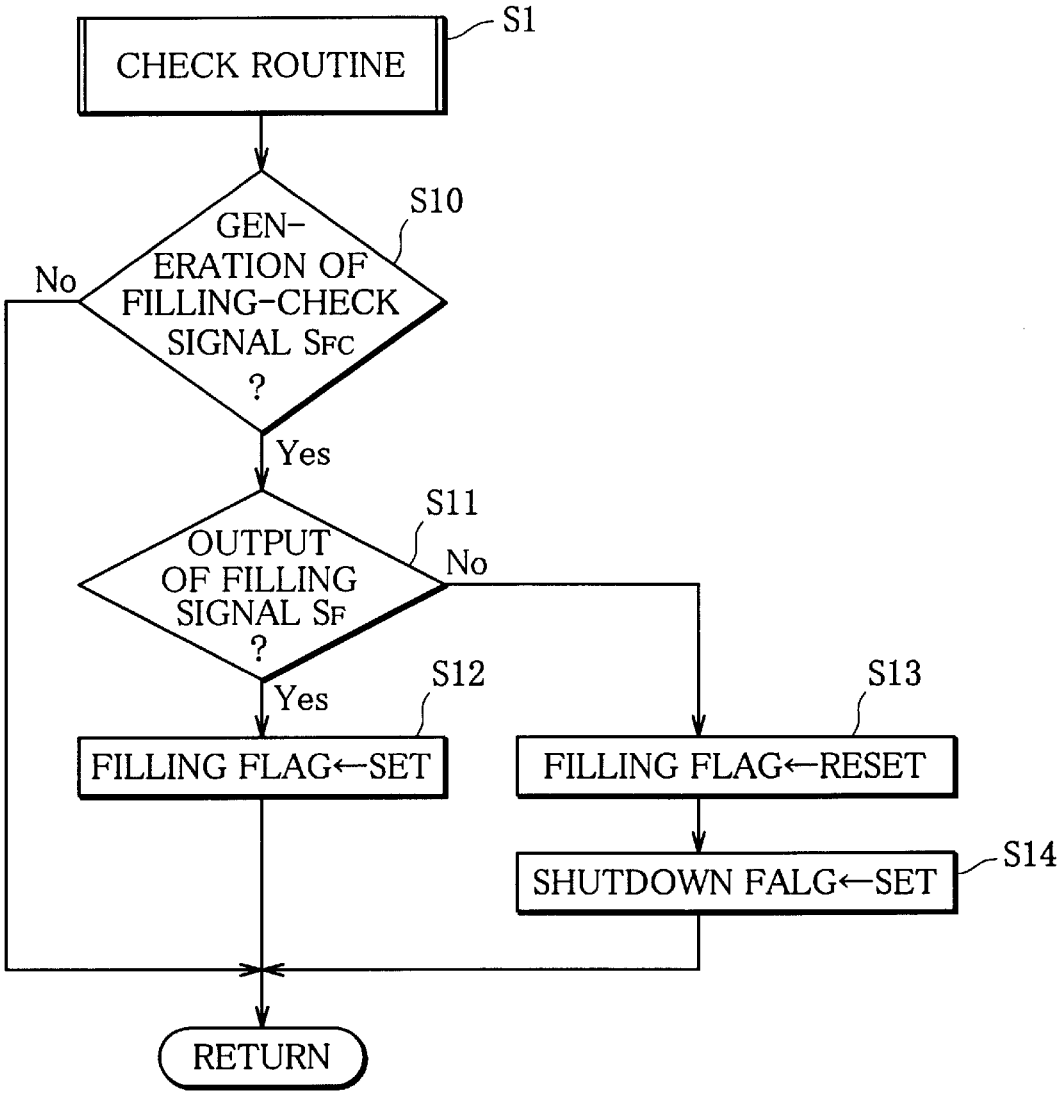
FIG. 9 is a flowchart showing details of a check routine shown in FIG. 8.

Details of the check routine are shown in FIG. 9. The control-arithmetic unit 88 determines whether the filling check signal $S_{FC}$ is generated from the first generating section 90 (step S10). If "Yes" in step S10, the unit 88 determines whether the filling signal $S_F$ is being output from the weight feeder 6 (step S11). If "Yes" here, the unit 88 sets a filling flag.

If "No" in step S11, the unit 88 resets the filling flag (step S13), and sets a shutdown flag (step S14). When the filling flag is set or reset, the unit 88 completes the check routine S1, and executes the control routine S2 for the feed units 21.

When the packing machine (weight feeder 6) is in the steady operating state, the decision result in step S11 always become "Yes". In this case, the filling flag is maintained in a state where the filling flag is always set as apparent from FIG. 9.

Whereas, when the accumulating amount of articles in the weight feeder 6 is insufficient or the weight feeder 6 does not drop the articles due to trouble of the weight feeder 6 itself, the weight feeder 6 does not output the filling signal $S_F$. In this time, there is no filling signal $S_F$ which should be output, such a filling signal $S_F$ is indicated with a broken line in FIG. 7. In such a state, the decision result in step S11 becomes "No", and the filling flag is changed over from "set" to "reset" as shown in FIG. 9, and the shutdown flag is set.

When the shutdown flag is set, the control-arithmetic unit 88 outputs the waiting signal $S_W$ to the weight feeder 6. Upon reception of the waiting signal $S_W$, the weight feeder 6 halts the filling operation of the articles. Therefore, since the weight feeder 6 outputs no filling signal $S_F$ thereafter, the decision result in step S11 always becomes "No". As a result, the filling flag is maintained in the reset state, and the shutdown flag is maintained in the set state.

Control Routine for the Feed Units

Figure 10:
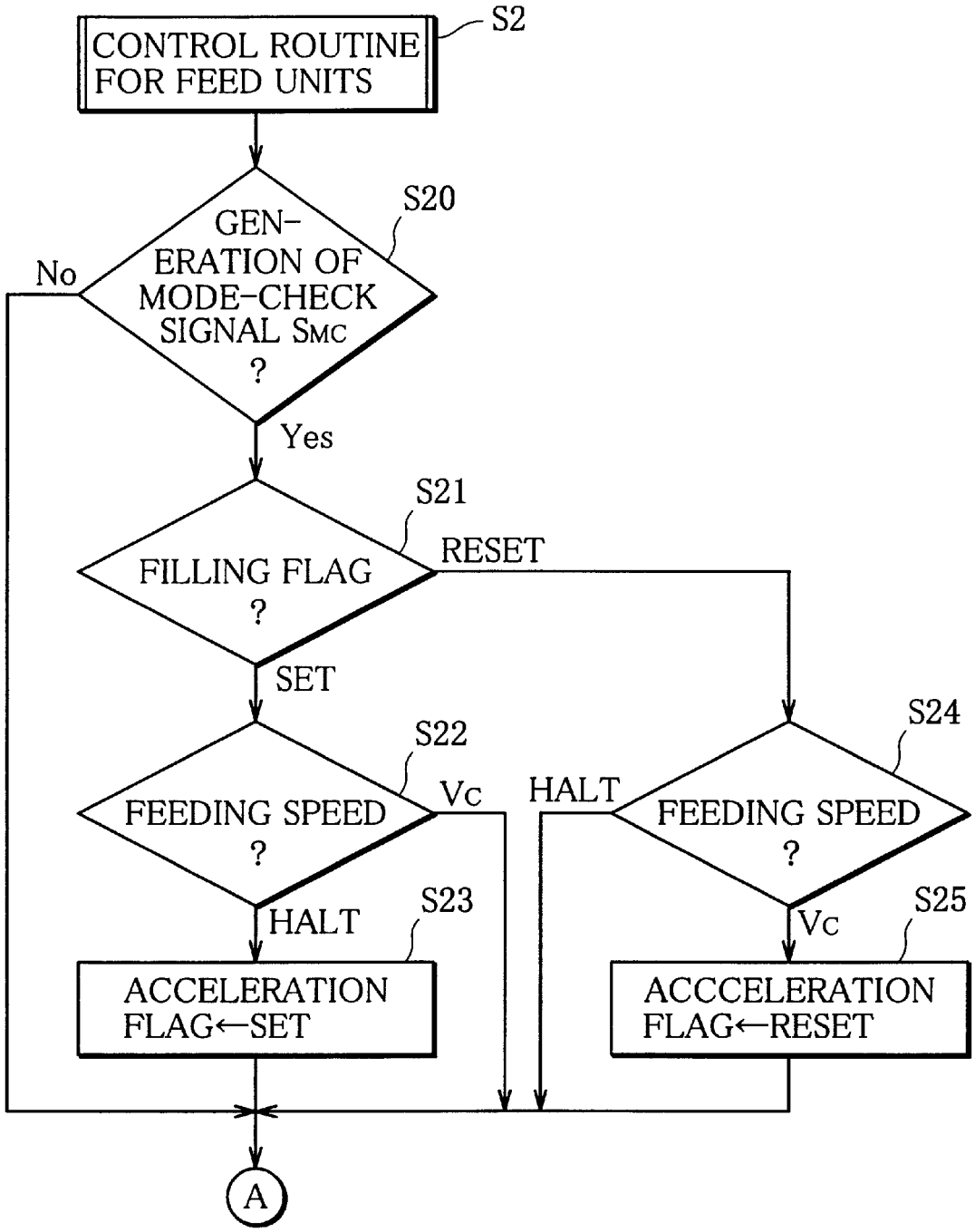
FIGS. 10 and 11 are flowcharts showing details of a control routine for the feed unit shown in FIG. 8.
Figure 11:
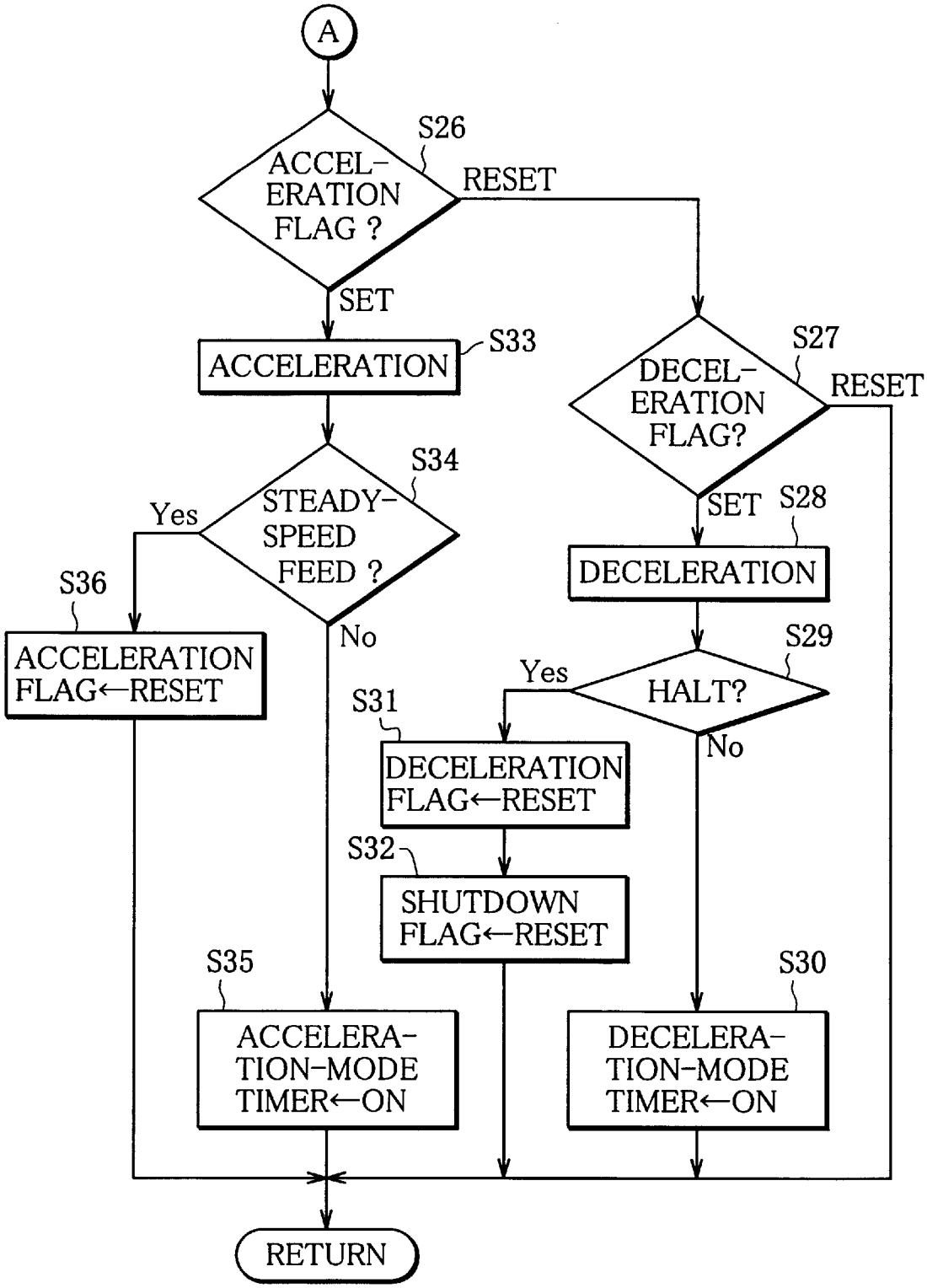

Details of the control routine S2 are shown in FIGS. 10 and 11. First, the control-arithmetic unit 88 determines whether the mode-check signal $S_{MC}$ is generated from the second generating section 92 (step S20). If "Yes" in step S20, the unit 88 determines the state of the filling flag (step S21).

If the unit 88 determines that the filling flag is set in step S21, the unit 88 determines whether the feeding speed of the packaging material F corresponds to a steady speed $V_C$, or whether the feeding operation is halted (step S22). If the decision result here is "$V_C$", this means that the packing machine is normally operating. In this case, the unit 88 bypasses the subsequent step S23, and executes step S26 shown in FIG. 11. However, if the decision result in step S22 is "HALT", the unit 88 sets an acceleration flag in step S23 and then, executes step S26. Here, it is possible for the unit 88 to determine that the packaging material F is halted based on the halting signal $S_S$ sent from the feed units 21.

On the other hand, if the decision result in step S21 is "RESET", the unit 88 determines the feeding speed of the packaging material F as in the step S22 (step S24). If the decision result here is "HALT", this means that the operation of the packing machine is halted. In this case, the unit 88 bypasses the subsequent step S25 and executes step S26 shown in FIG. 11. Whereas, if the decision result in step S24 is "$V_C$", i.e., if the packaging material F is still in the feeding state, the unit 88 sets the deceleration flag in step S25 and then, executes step S26.

The unit 88 determines the state of the acceleration flag in step S26 shown in FIG. 11. If the decision result here is "RESET", the unit 88 determines the state of the deceleration flag (step S27). If the decision result here is "RESET" again, i.e., if the packing machine is in the steady operation state or the shutdown state, the unit 88 completes the control routine S2, and executes the next control routine S3.

However, if the decision result in step S27 is "SET", the unit 88 decelerates the servomotor 27 of each of the feed units 21, i.e., the feeding speed of the packaging material F at a predetermined rate (step S28). Here, at the point of time when the deceleration of the servomotor 27 is started, the packaging material F is still fed at the steady speed $V_C$ even though the filling flag is reset, i.e., even though there is non-filling operation of the articles into the filling tube 2 from the weight feeder 6.

As shown in FIG. 7, after the filling flag is changed over from "set" to "reset", the deceleration mode of the packaging material F is started from the instant when the first mode-check signal $S_{MC}$ is generated. The deceleration of the packaging material F is determined such that the packaging material F is completely stopped at the instant when the next mode-check signal $S_{MC}$ is generated. That is, the deceleration of the packaging material F in the deceleration mode is gently performed from the state of the steady speed feeding using the generation cycle in the mode-check signal $S_{MC}$, i.e., the entire region of the above-described one packing cycle time $S_P$.

Next, the unit 88 determines whether the packaging material F is halted (step S29), and if "No", the deceleration-mode timer 94 is turned ON (step S30) and then, the next control routine S3 is executed. Here, the count time by the deceleration-mode timer is set to about half of the generation cycle of the mode-check signal $S_{MC}$, i.e., of the time period of the deceleration mode for example.

The deceleration in step S28 is carried out repeatedly, and if the decision result in step S29 becomes "Yes" and the feeding operation of the packaging material F is halted, the unit 88 resets the deceleration flag (step S31) and resets the shutdown flag (step S32). If the shutdown flag is reset in this manner, the unit 88 halts the output of the waiting signal $S_W$ to the weight feeder 6, thereby allowing the weight feeder 6 to restart its operation.

On the other hand, if the decision result in step S26 is "SET", the unit 88 accelerates the servomotor 27 of each of the feed units 21 and feeds the packaging material F at a predetermined acceleration (step S33). The start of acceleration of the packaging material F means that the packaging material F is fed from the halt state as a result of restarting the filling operation of the articles from the weight feeder 6.

When the feeding operation of the packaging material F is once shifted to the deceleration mode as described above, it is necessary to reset the shutdown flag in order to restart the operation of the weight feeder 6.

As shown in FIG. 7, the acceleration mode of the packaging material F is started from the instant when the first mode-check signal $S_{MC}$ is generated after the filling flag is changed over from "reset" to "set". The acceleration in the acceleration mode is determined such that the steady speed feeding of the packaging material F is completed when the next mode-check signal $S_{MC}$ is generated. That is, the packaging material F is gently accelerated using the generation cycle of the in the mode-check signal $S_{MC}$, i.e., the entire region of one packing cycle time.

Next, the unit 88 determines whether the packaging material F is in the state of the steady-speed feed (step S34). If the decision result here is "No", the acceleration-mode timer is turned ON (step S35) and then, the next control routine S3 is executed. Here, the count time of the acceleration-mode timer is set to about half of the generation cycle of the mode-check signal $S_{MC}$, i.e., of the time period (see FIG. 7) of the acceleration mode for example.

When the acceleration in step S33 is repeatedly carried out and then the decision result in step S34 becomes "Yes", i.e., when the packaging material F assumes the steady speed feeding state, the unit 88 resets the acceleration flag (step S36) and executes the control routine S3.

Control Routine for the Center Heat Sealer

Figure 12:
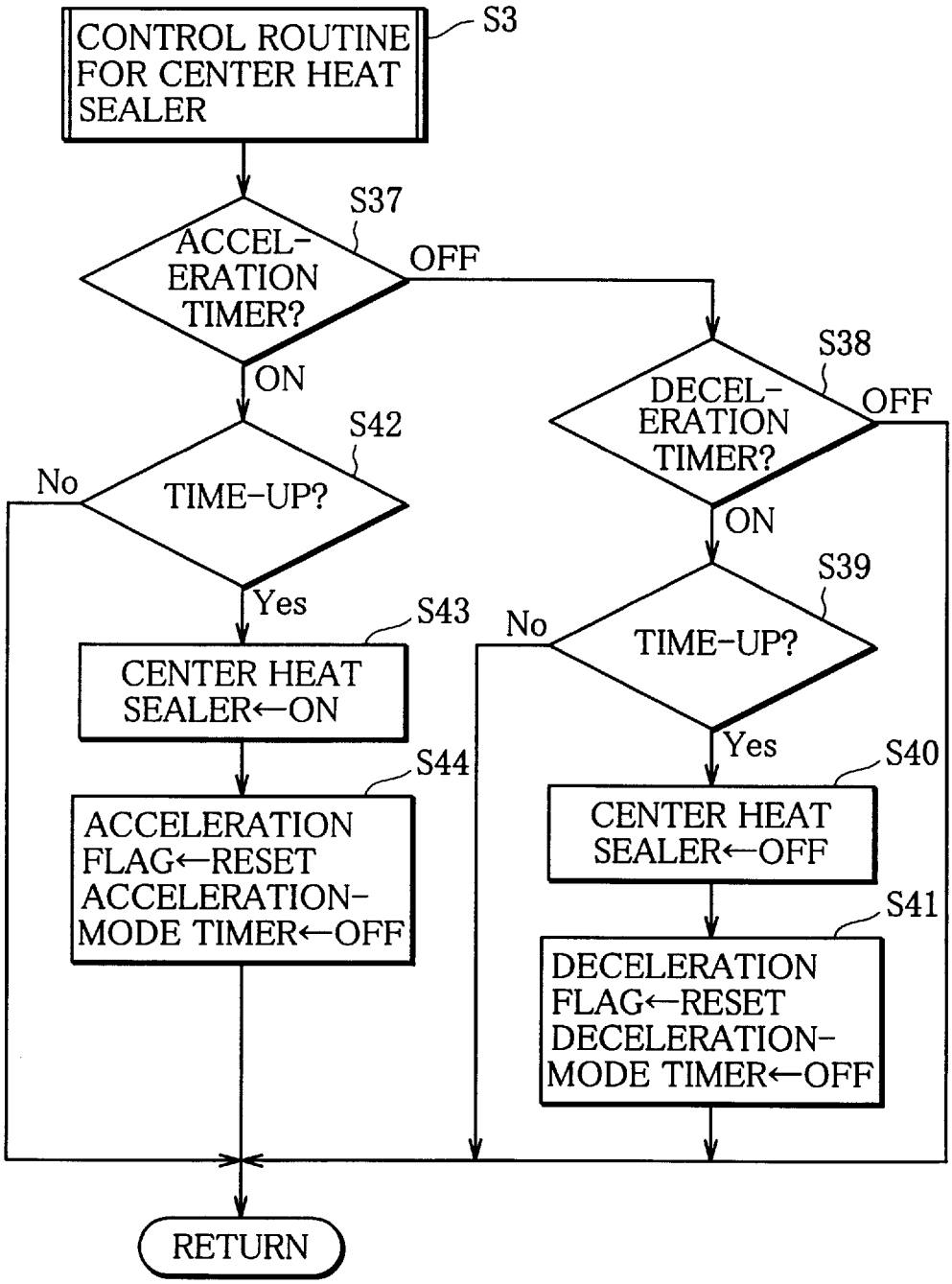
FIG. 12 is a flowchart showing details of the control routine for the center heat sealer shown in FIG. 8.

Details of the control routine are shown in FIG. 12. The control-arithmetic unit 88 determines the state of the acceleration-mode timer (step S37), and if the decision result here is "OFF", the unit 88 determines the state of the deceleration-mode timer (step S38). If the decision result here is also "OFF", the unit 88 completes the control routine S3, and executes the above-described check routine S1 and subsequent routine repeatedly. That is, the control routine S3 can not be substantially executed unless both the acceleration-mode timer and the deceleration-mode tire are ON. In this case, the operation of the center heat sealer 24 is not controlled and is maintained in the ON state for heating the seam of the packaging material F.

If the decision result in step S38 is "ON", the feeding operation of the packaging material F is shifted from the steady feeding mode to the deceleration mode. In such a state, the unit 88 determines whether the counted time of the deceleration-mode timer has been elapsed, i.e., whether time is up (step S39). If the decision result here is "No", the unit 88 bypasses steps S40 and S41, and completes the control routine S3.

During the deceleration mode of the packaging material F, when the decision result in step S39 becomes "Yes", the unit 88 turns OFF the center heat sealer 24 in step S40. More specifically, the heater block 66 of the center heat sealer 24 is retreated from the filling tube 2 by the air cylinder 76.

Then, the unit 88 resets the deceleration flag and turns OFF the deceleration-mode timer in step S41.

Therefore, the unit 88 should not turn OFF the center heat sealer 24 immediately after the feeding operation of the packaging material F is shifted to the deceleration mode. In more detail, the center seal for the packaging material F by means of the center heat sealer 24, i.e., ON operation of the center heat sealer 24 is halted when the time period set in the deceleration-mode timer has been elapsed during the deceleration mode of the packaging material F as shown in FIG. 7.

Here, the advancing and retreating movements of the heater block 66 with respect to the filling tube 2 are carried out by the air cylinder 76. Therefore, even though the time period set in the deceleration-mode timer is elapsed, the center heat sealer 24 is not changed over to the OFF operation immediately as apparent from FIG. 7. However, the OFF operation of the center heat sealer 24 is completed during the deceleration mode. For this reason, the packaging material F is completely halted after the center heat sealer 24 is turned OFF (see step S29).

On the other hand, if the decision result in step S37 is "ON", the feeding operation of the packaging material F is shifted from the halting state to the acceleration mode. In this case, the unit 88 determines whether the time period set in the acceleration-mode timer is elapsed (step S42). If the decision result here is "No", the unit 88 bypasses the nest steps S43 and S44, and completes the control routine S3. Here, if the feeding operation of the packaging material F is shifted from the halting state to the acceleration mode, the above-described deceleration mode has already been carried out. Therefore, at that time, the center heat sealer 24 is in the OFF operation state, and the heater block 66 is in the retreated position separated away from the filling tube 2.

Thereafter, during the execution of the acceleration mode for the packaging material F, if the decision result in step S42 becomes "Yes", the unit 88 turns ON the center heat sealer 24 in step S43. At this time, the heater block 66 advances toward the filling tube 2, and the center seal of the packaging material F is restarted. Then, in step S44, the unit 88 resets the acceleration flag, and turns OFF the acceleration-mode timer.

As described above, the center heat sealer 24 is turned ON immediately, not at the time when the acceleration mode of the packaging material F is started but at the time when the time period set ins the acceleration-mode timer is elapsed. As shown in FIG. 7, a delay occurs in the changing over from the OFF operation to the ON operation of the center heat sealer 24, but the ON operation of the center heat sealer 24 is completed during the acceleration mode, and then the feeding speed of the packaging material F becomes the steady speed $V_C$ (see step S34).

FIG. 7 also shows the timing of rising/lowering movement and timing of opening/closing movement of the top heat sealer 26.

Figure 13:
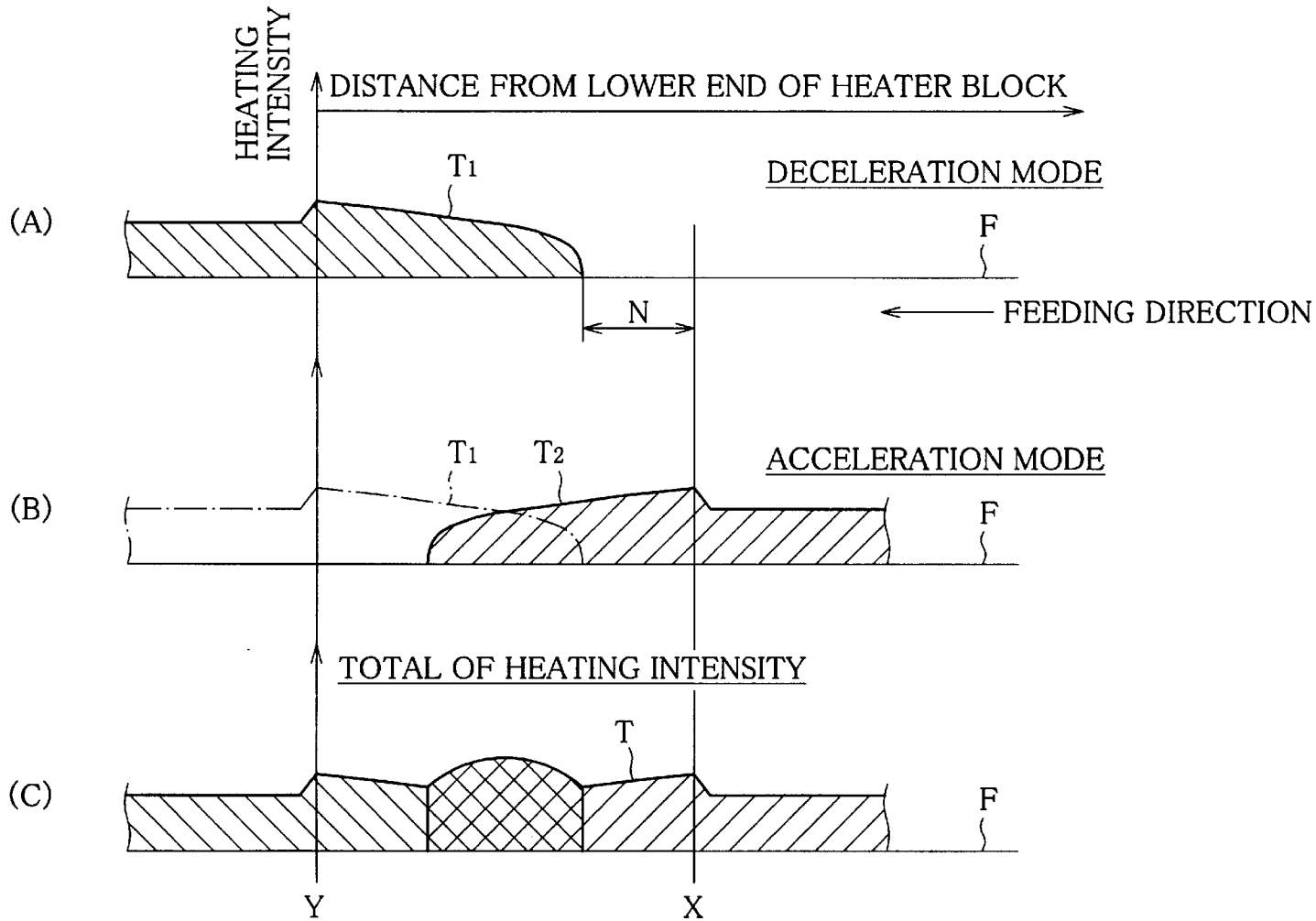
FIGS. 13*a*–13*c* are views showing heating intensity during a deceleration mode and an acceleration mode of the packaging material.

In such a state that a filling operation of the articles ends in failure and the feeding operation of the packaging material F is shifted from the steady speed mode to the deceleration mode, the center heat sealer 24 is turned OFF after a predetermined delay time is elapsed from the start of the deceleration mode. Therefore, the heating intensity $T_1$ applied to the packaging material F by the heater block 66 is varied as shown in (A) of FIG. 13. That is, when the feeding speed of the packaging material F is the steady speed $V_C$, the heating intensity $T_1$ is constant. However, if the feeding operation of the packaging material F is shifted to the deceleration mode, the heating intensity $T_1$ is once increased, and is gradually decreased as the center heat sealer 24 is retreated from the filling tube 2. Further, even if the OFF operation of the center heat sealer 24 is completed, the feeding of the packaging material F is continued. For this reason, when the packaging material F is stopped after that, the seam of the packaging material F have non-heat seal portion N which at the region of the heating block 66 is not heated from the upper end of the heater block 66 through a predetermined length. In FIG. 13, X and Y respectively represents the upper end position and the lower end position of the heater block 66.

Thereafter, when the feeding operation of the packaging material F is shifted from the halting state to the acceleration mode in which the feeding speed is accelerated to the steady speed $V_C$, the center heat sealer 24 is turned ON after a predetermined delay time is elapsed from the starting of the acceleration mode. Therefore, a heating intensity $T_2$ applied to the packaging material F is varied as shown in (B) of FIG. 13. In this case, even if the acceleration mode is started, the seam of the packaging material F, which at the region of the heater block 66 is not heated from the lower end of the heater block 66 through a predetermined distance. When the center heat sealer 24 is turned ON after that, the heating intensity $T_2$ is gradually increased. Thereafter, the feeding speed of the packaging material F reaches the steady speed $V_C$, the heating intensity $T_2$ is once decreased, and becomes constant.

Therefore, when the feeding operation of the packaging material F is returned to the steady speed from the halted state, the seam of the packaging material F which were at the region of the heater block 66 is heated at the heating intensity T which is the sum of the heating intensities $T_1$ and $T_2$ as shown in (C) of FIG. 13. In this case, as apparent from FIG. 13, since the overlapped portions of the heating intensities $T_1$ and $T_2$have lower intensity levels respectively. Thus, even if the seam of the packaging material F is heated at both the heating intensities $T_1$ and $T_2$, the seam should not be heated excessively.

As a result, after the packaging material F is stopped, even if the feeding operation of the packaging material F is restarted at the steady speed, the seam of the packaging material F should not be excessively or insufficiently fused and connected, and the center seal should not be disfigured. These heating intensities $T_1$ and $T_2$are appropriately determined while taking into the consideration the fact that the packaging material F is heated at the heating intensity which is the sum of the heating intensities $T_1$ and $T_2$.

Figure 14:
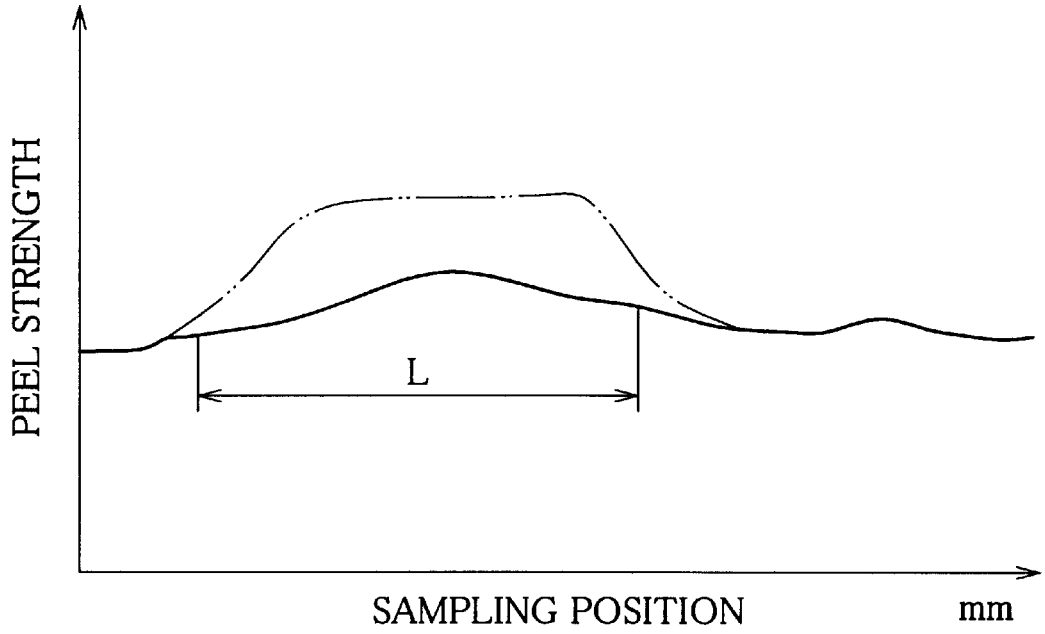
FIG. 14 is a graph showing peel strength of a center seal obtained immediately after the operation of the machine is restarted from its halt state.

FIG. 14 shows the peel strength of the center seal obtained when the steady speed feeding of the packaging material F from its halt state is restarted. In FIG. 14, L represents a portion of the center seal which corresponds to the length of the heater block 66 and is obtained immediately after the restart of the feeding of the packaging material F. Although the center of the L portion is heated at the heating intensity which is the sum of the heating intensities $T_1$ and $T_2$, the peel strength is not excessively increased as compared with opposite ends of the L portion.

In this respect, if the start of the acceleration mode for the packaging material F and the ON operation of the center heat sealer 24 are performed simultaneously, or when the center heat sealer 24 is turned ON before the start of the acceleration mode for the packaging material F, the fusion adhesion of the seam of the packaging material F is carried out excessively, and the peel strength of the center seal at the excessive fusion adhesion portion is extremely increased as compared with other portions as shown with the two-dot line in FIG. 14.

Figure 15:
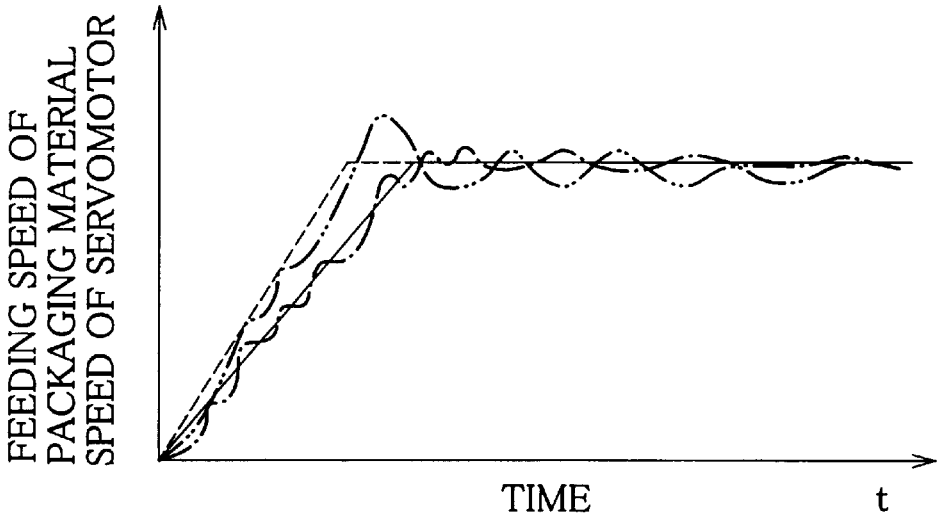
FIG. 15 is a graph showing a relation between the revolution speed of a servomotor of the feed unit and a feeding speed of the packaging material.

Further, during the deceleration mode and the acceleration mode for the packaging material F, the deceleration and the acceleration of the packaging material F are gently carried out. That is, as shown with a thin solid line in FIG. 15, the acceleration of the servomotor 27 is low. Therefore, the feeding operation of the packaging material F excellently follows the acceleration of the servo motor 27 as shown with the one-dot line, and wrinkle should not be caused in the center seal of the packaging material F. On the contrary if the acceleration of the servomotor 27 is high as shown with the thin broken line in FIG. 15, fluctuation is liable to be caused in the feeding of the packaging material F as shown with the two-dot line, which becomes a cause of generation of wrinkle in the center seal. Even in the deceleration mode for the packaging material F, it is possible to effectively prevent the wrinkle from being generated in the center seal for the same reason.

Since the deceleration mode and the acceleration mode for the packaging material F are completed within one packing cycle period $S_P$ of the packing machine, defective packaged products P should not be produced when the packing machine is halted or restarted.

The present invention should not be limited to the above-described one embodiment, and various modifications are possible. For example, it is most preferable that the center heat sealer 24 is turned OFF during the deceleration mode for the packaging material F and the center heat sealer 24 is turned ON during the acceleration mode for the packaging material F as in the embodiment. However, for carrying out the present invention, the center heat sealer 24 may be turned ON or OFF only during one of the deceleration mode and the acceleration mode.

Further, in the embodiment, when a filling operation of articles is skipped during the intermittent filling process, the operation of the weight feeder 6 is halted and then, the feeding speed of the packaging material F is once halted completely from the steady speed. Thereafter, when the intermittent filling process is restarted, the feeding speed of the packaging material F is returned to the steady speed. Therefore, the feeding speed of the packaging material F is only controlled linearly between the halted state to the steady speed. However, the feeding speed can also be controlled stepwisely during the deceleration or acceleration mode.

Figure 16:
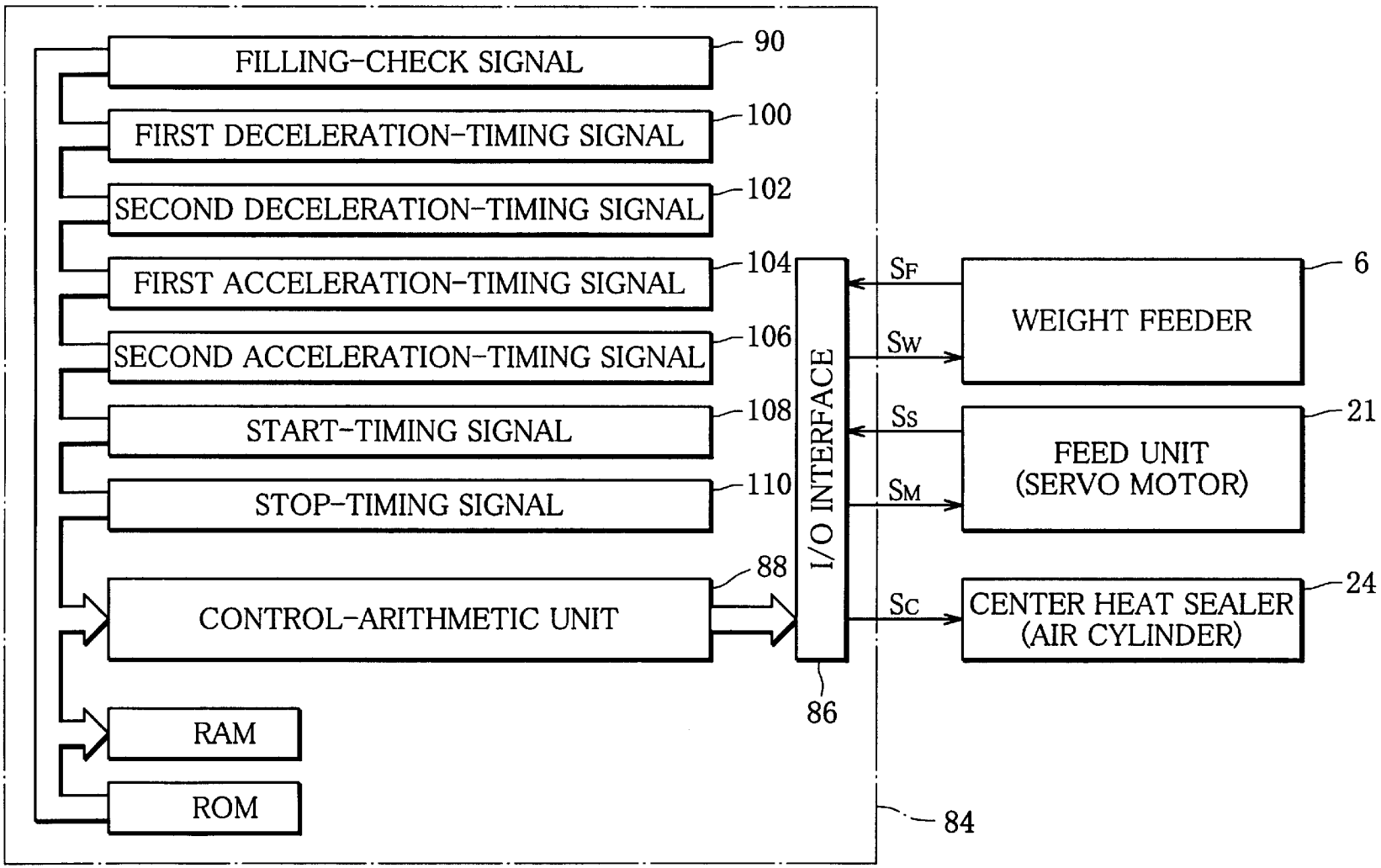
FIG. 16 is a schematic view showing a controller according to a modification.

In this case, the structure of the controller 84 of the vertical sealing device is changed from that shown in FIG. 6 to that shown in FIG. 16.

Figure 17:
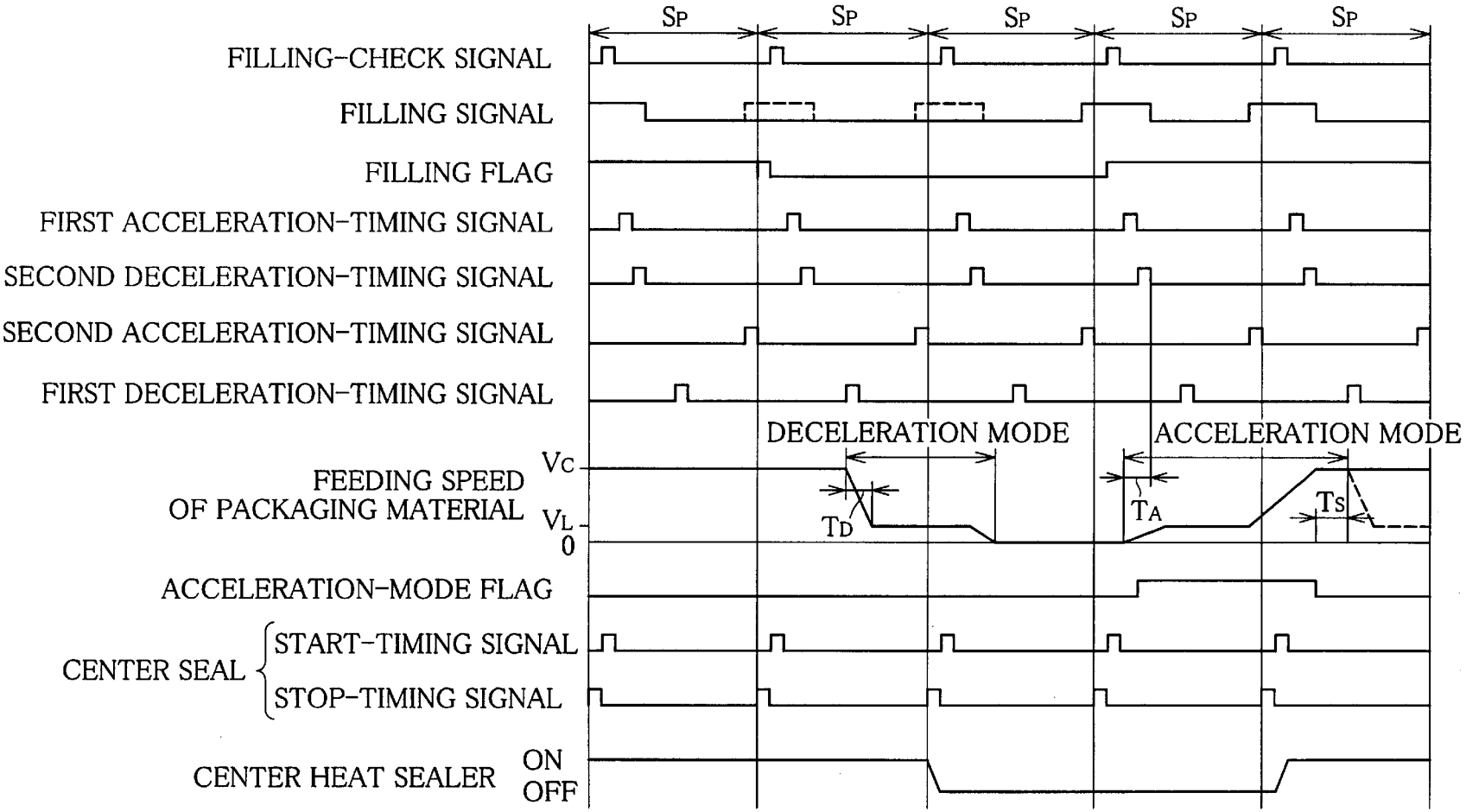
FIG. 17 is a timing chart showing a relation between a feeding state of the packaging material fed by the feed unit and the ON/OFF operation of the center heat sealer.

A controller 84 in FIG. 16 comprises a generating section 100 for generating a first deceleration-timing signal, a generating section 102 for generating a second deceleration-timing signal, a generating section 104 for generating a first acceleration-timing signal, a generating section 106 for generating a second acceleration-timing signal, a generating section 108 for generating a start-timing signal for a center seal, and a generating section 110 for generating a stop-timing signal for the center seal, instead of the generation section 92 for generating the above-described mode-check signal, the deceleration-mode timer 94 and the acceleration-mode timer 96. These generating sections 100 to 110 respectively output timing signals in the same one packing cycle period $S_P$ as shown in FIG. 17.

More specifically, suppose that each of the packing cycle period $S_P$ is divided into an initial stage, an intermediate stage and a late stage, for example. In this case, if the filling-check signal is generated in the initial stage, the generating section 104 generates the first acceleration-timing signal subsequent to the filling-check signal in the initial stage, and the generating section 102 generates the second deceleration-timing signal at the end of the initial stage. The generating section 106 generates the second acceleration-timing signal at the end of the late stage, and the generating section 100 generates the first deceleration timing signal at the middle of the intermediate stage.

The generating section 108 generates the start-timing signal at the same timing as the filling-check signal in the initial stage, and the generating section 110 generates the stop-timing signal prior to the start-timing signal in the initial stage.

In the case of this embodiment, the control-arithmetic unit 88 does not use the shutdown flag and thus, does not output the waiting signal $S_W$ to the weight feeder 6.

Figure 18:
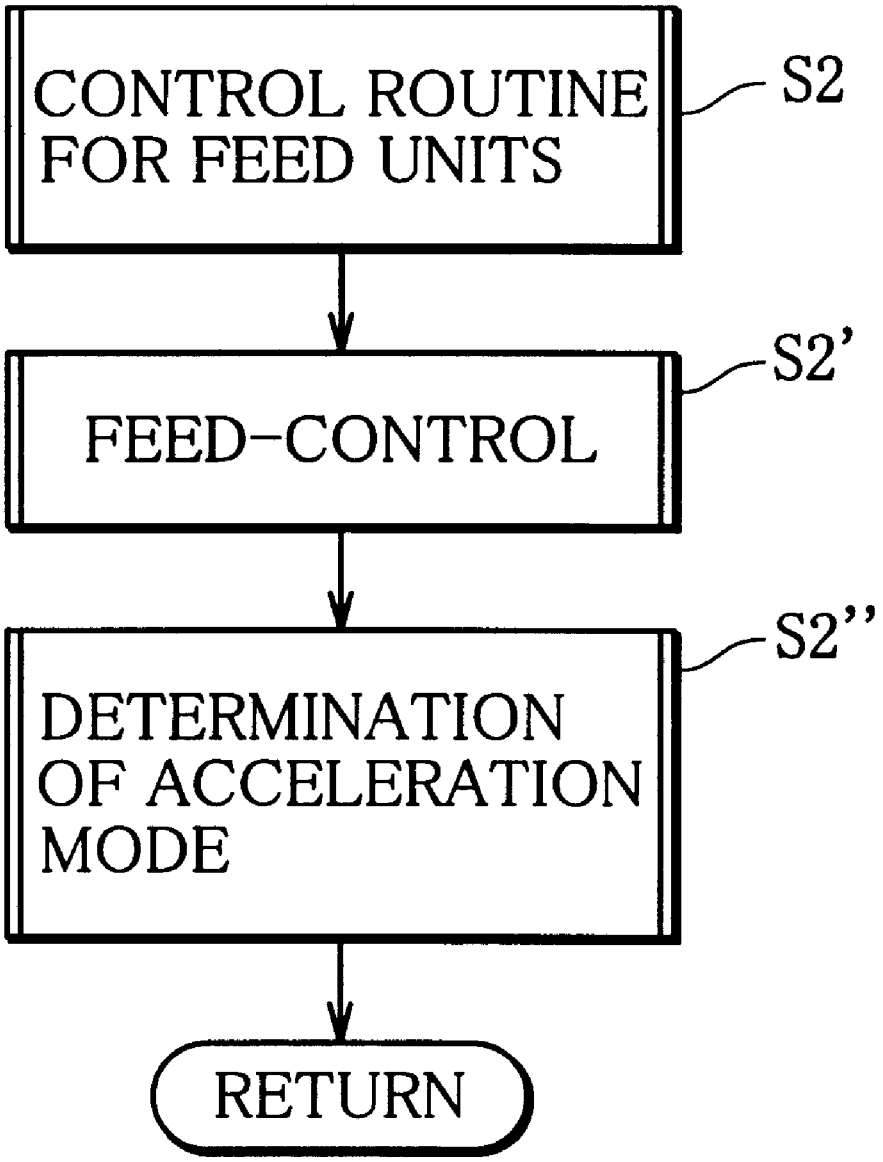
FIG. 18 is a flowchart showing a modification of a control routine for the feed unit.

A control routine for the feed units 21 of the controller 84 shown in FIG. 16 comprises two sub-routines, i.e., a feed-control routine S2' and a determination routine S2" for an acceleration mode as shown in FIG. 18. These routines S2' and S2" will be explained in detail below.

Feed Control Routine

Details of the routine S2' are shown in FIGS. 19 to 27. In a flowchart in FIG. 19, concerning the feeding operation of the packaging material F, the control-arithmetic unit 88 of the controller 84 successively determines:

a) whether the feeding operation is halted (step S100);
b) whether the first acceleration mode is being selected (step S200);
c) whether the acceleration mode is temporarily discontinued or suspended (step S300);
d) whether the second acceleration mode is being selected (step S400);
e) whether the steady speed is maintained (step S500);
f) whether the first deceleration mode is being selected (step S600);
g) whether the deceleration mode is temporarily discontinued or suspended (step S700); and
h) whether the second deceleration mode is being selected (step S800).

If the decision results are all "No", the unit 88 determines that the feed units 21 are under abnormal condition, and halts the packing machine (abnormal stop) (step S1000).

When the packing machine is being operated normally, the packaging material F is fed at the steady speed $V_C$. Therefore, in such a state, the decision result in step S500 becomes "Yes", and the unit 88 executes a routine shown in FIG. 20.

When the packing machine is being operated normally, a length of the packaging material F fed during one packing cycle period $S_P$ coincides with a length of one packaged product P, and the length of the fed packaging material F is expressed as the product of the one packing cycle period $S_P$ and the feeding speed of the packaging material F.

Figure 20:
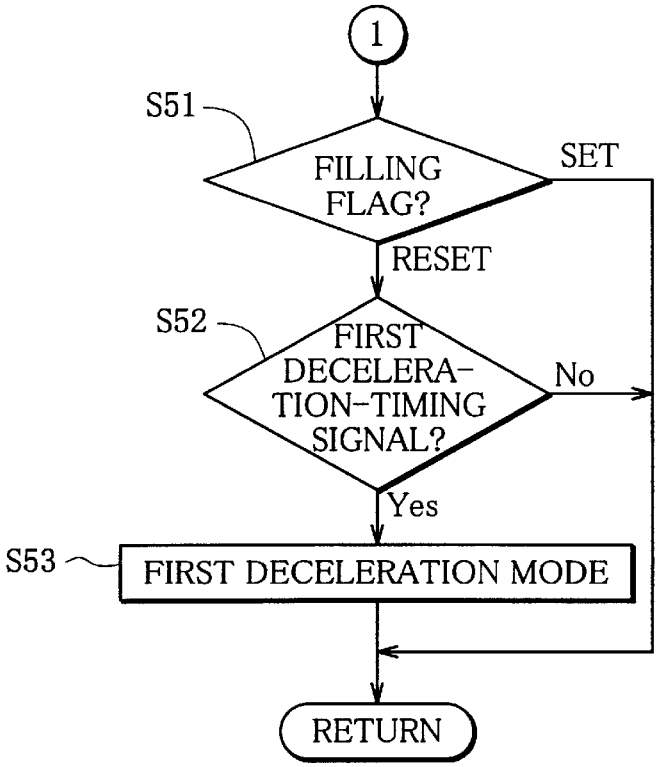

In the routine shown in FIG. 20, the unit 88 first determines the state of the filling flag (step S51). If the decision result here is "SET", the unit 88 executes the main routine shown in FIG. 8. Therefore, during the steady operation of the packing machine, the unit 88 repeatedly executes the determinations in steps S500 and S51 only.

When a filing operation of the articles is skipped and the decision result in step S51 becomes "RESET", the unit 88 determines whether the first deceleration-timing signal is generated (step S52). If the decision result here becomes "Yes", the unit 88 performs the deceleration mode, i.e., the first deceleration mode of the packaging material F (step S53). By performing the first deceleration mode, the feeding of the packaging material F is decelerated at a first deceleration as shown in FIG. 17.

Figure 19:
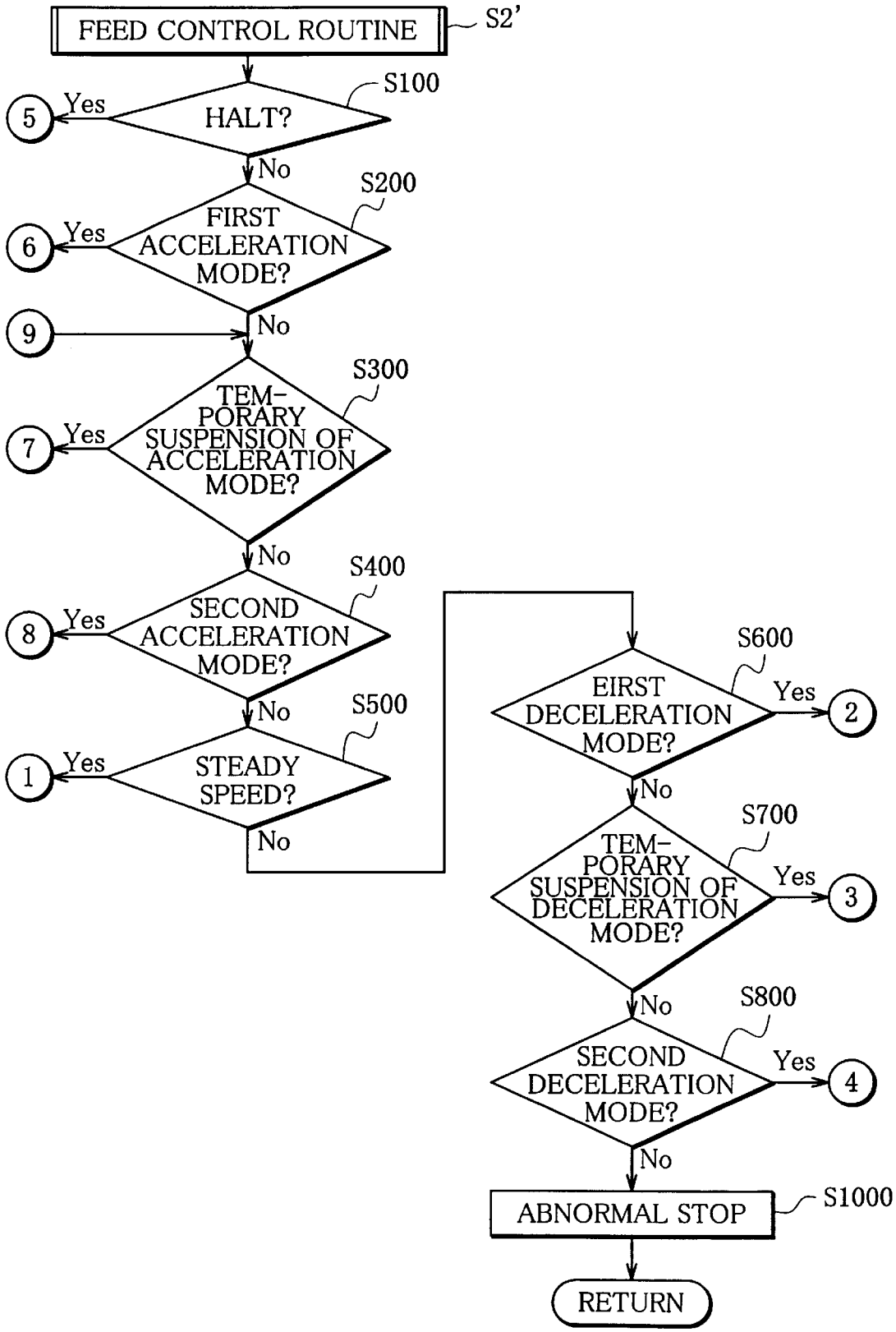
FIGS. 19 to 27 are flowcharts showing details of the feeding control routine in FIG. 18.
Figure 21:
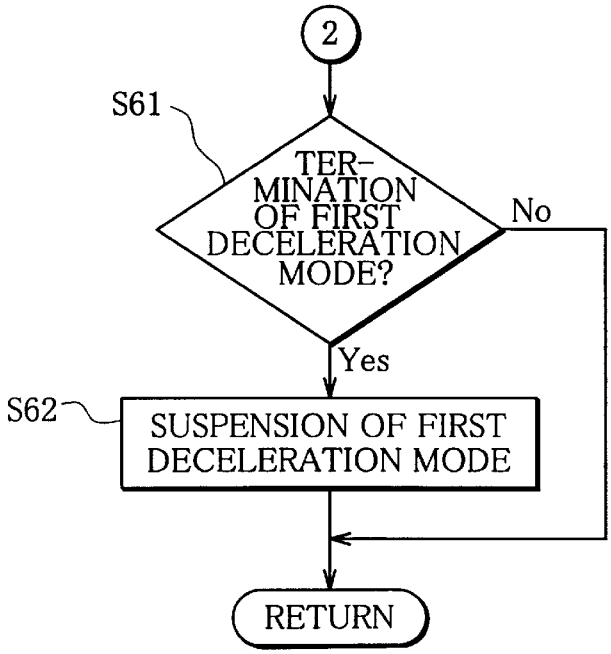

When the feeding operation of the packaging material F is shifted to the first deceleration mode, the decision result in step S600 becomes "Yes" according to the routine shown in FIG. 19, and in this case, the unit 88 executes a routine shown in FIG. 21. In this routine, the unit 88 determines whether the first deceleration mode is completed or terminated (step S61). More specifically, the unit 88 determines whether a predetermined time $T_D$ is elapsed from the start of the first deceleration mode. Here, the predetermined time $T_D$ is set to time shorter than an interval between the timing when the first deceleration-timing signal is generated and the timing when the second acceleration-timing signal is generated.

If the decision result in step S61 becomes "Yes", the unit 88 discontinues or suspends the first deceleration mode (Step S62), and maintains the feeding speed of the packaging material F at a speed $V_L$ which is a speed at the time when the first deceleration mode is discontinued (see FIG. 17). Here, the speed $V_L$ is set to about ⅕ to ⅖ of the steady speed $V_C$.

Figure 22:
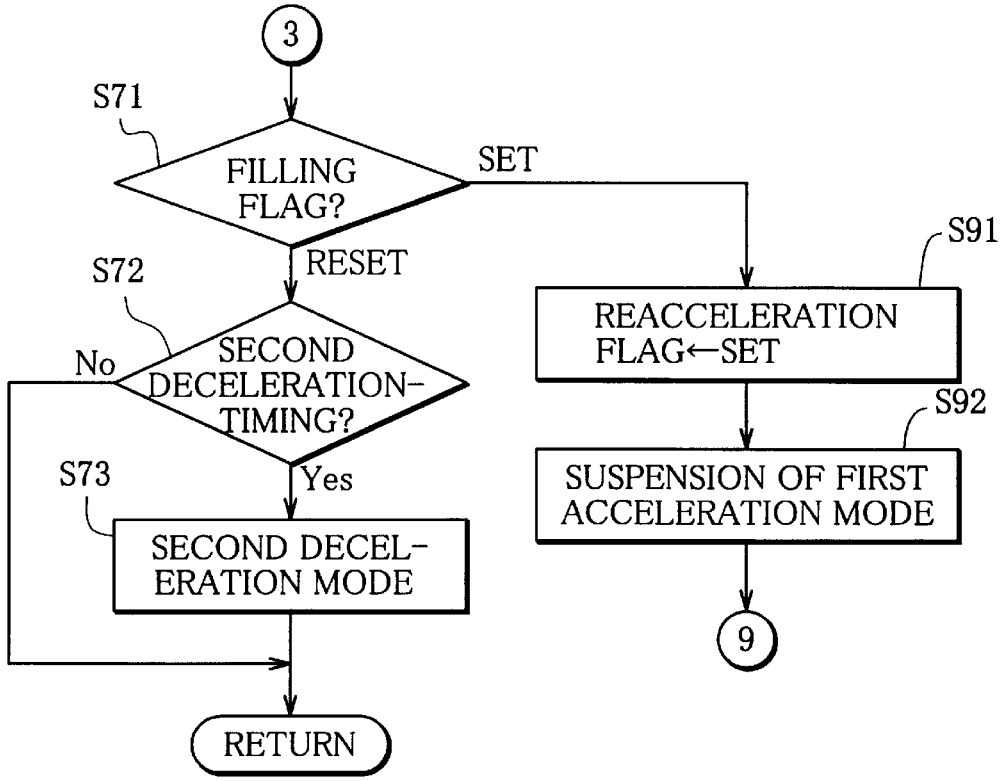

Thereafter, since the decision result in step S700 becomes "Yes" according to the routine in FIG. 19, the unit 88 executes a routine shown in FIG. 22. In this routine, the unit 88 first determines the state of the filling flag (step S71). If the decision result here becomes "RESET", this means a situation where "non-filling operation" of articles is continued (see the filling signal shown with broken lines) as apparent from FIG. 17. In this case, the unit 88 determines whether the second deceleration-timing signal is generated, i.e., whether the current time is in the second deceleration timing (step S72). Until the decision result here becomes "Yes", the feeding speed of the packaging material F is maintained at the speed $V_L$. If the decision result in step S72 becomes "Yes", the unit 88 performs the feeding operation of the packaging material F in the second deceleration mode (step S73). In this second deceleration mode, the packaging material F is decelerated at a second deceleration which is smaller than the first deceleration.

Figure 23:
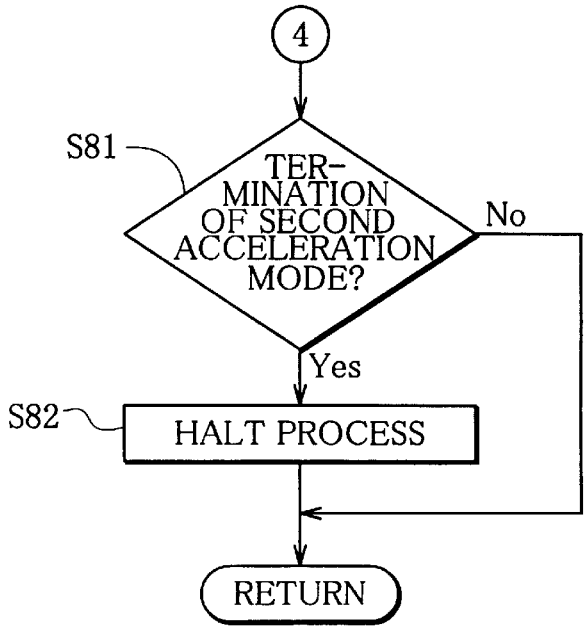

If the second deceleration mode is performed, the decision result in step S800 becomes "Yes" according to the routine shown in FIG. 19, and the unit 88 executes a routine shown in FIG. 23. In this routine, the unit 88 determines whether the second deceleration mode is completed or terminated (step S81). More specifically, in step S81, the unit 88 determines whether the feeding speed of the packaging material F is 0, and if the decision result here becomes "Yes", halt process of the packaging material F is carried out (step S82). At this instant, the deceleration mode is completed.

Figure 24:
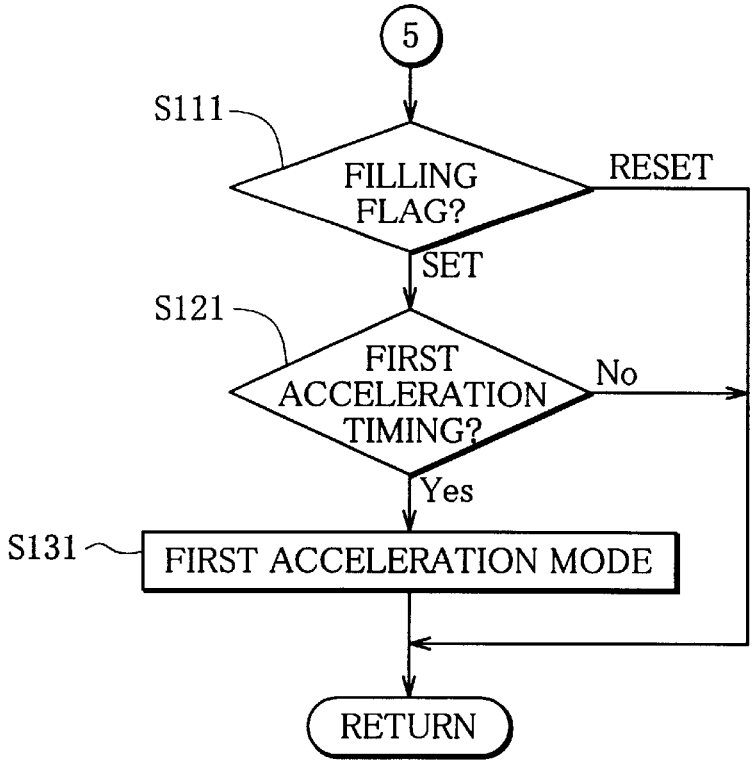

When the feeding operation of the packaging material F is halted, the decision result in step S100 becomes "Yes" according to the routine shown in FIG. 19, and thus, the unit 88 executes a routine shown in FIG. 24. In this routine, the unit 88 determines the state of the filling flag (step S111). As long as the decision result here is maintained at "RESET", the packaging material F is maintained in the halt state.

However, when the feeding operation of the article is restarted and as a result, the decision result in step S111 becomes "SET", the unit 88 determines whether the first acceleration-timing signal is generated, i.e., whether the current timing is in the first acceleration timing (step S121). At the time when the decision result here becomes "Yes", the unit 88 performs the acceleration mode, i.e., the first acceleration mode of the packaging material F (step S131). That is, after the filling flag is changed over from "RESET" to "SET", when the next first acceleration-timing signal is generated, the first acceleration mode of the packaging material F is carried out. In this first acceleration mode, the unit 88 or the feeding units 21 feeds the packaging material F at a predetermined first acceleration in FIG. 17.

Figure 25:
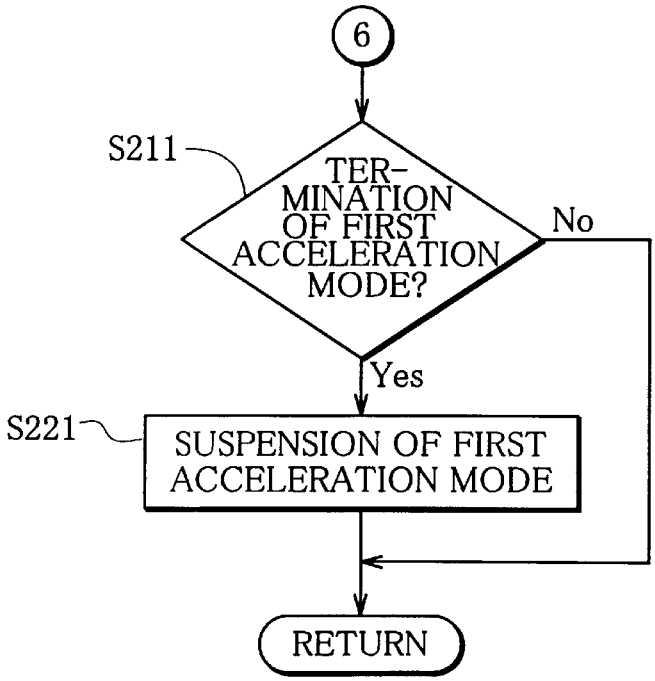

When the first acceleration mode is carried out, the decision result in step S200 becomes "Yes" according to the routine shown in FIG. 19, and the unit 88 executes a routine shown in FIG. 25. In this routine, the unit 88 determines whether the first acceleration mode is completed or terminated (stepS211). More specifically, the unit 88 determines whether a predetermined time $T_A$ (see FIG. 17) is elapsed from the start of the first acceleration mode. Here, the predetermined time $T_A$ is set shorter than the above-described predetermined time $T_D$, and the first acceleration of the packaging material F in the first acceleration mode is set such that the feeding speed of the packaging material F reaches the above-described speed $V_L$ when the predetermined time $T_A$ of the packaging material F in the first acceleration mode is elapsed.

When the decision result in step S211 becomes "Yes", the unit 88 discontinues or suspends the first acceleration mode of the packaging material F (step S222). Therefore, the feeding speed of the packaging material F is maintained at the speed $V_L$.

Figure 26:
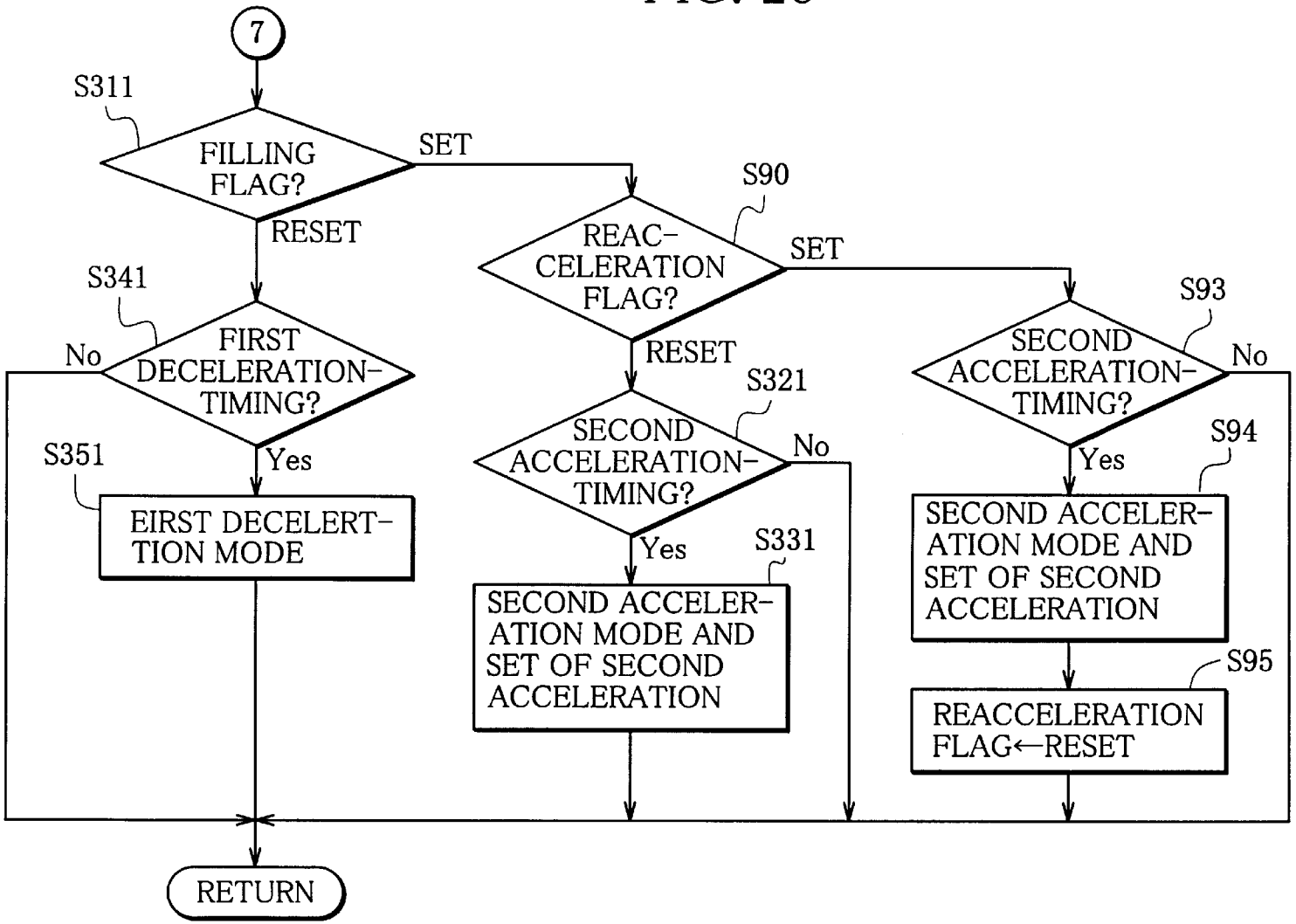

When the first acceleration mode of the packaging material F is discontinued, the decision result in step S300 becomes "Yes" according to the routine shown in FIG. 19, and the unit 88 executes a routine in FIG. 26. In this routine, the unit 88 determines the state of the filling flag (step S311). Here, when the routine in FIG. 26 is carried out for the first time, the decision result in step S311 becomes always "Yes" as apparent from FIG. 17. Therefore, the unit 88 then determines the state of a reacceleration flag which will be described later (step S90). At this time, since the reacceleration flag is not set, the decision result in step S90 becomes "RESET", the unit 88 determines whether the second acceleration-timing signal is generated, i.e., whether the current timing is in the second acceleration timing (step S321). If the decision result here becomes "Yes", the unit 88 performs the second acceleration mode of the packaging material F (step S331). In this step S331, the packaging material F is accelerated at a second acceleration. The absolute value of the second acceleration is smaller than that of the first deceleration.

Figure 27:
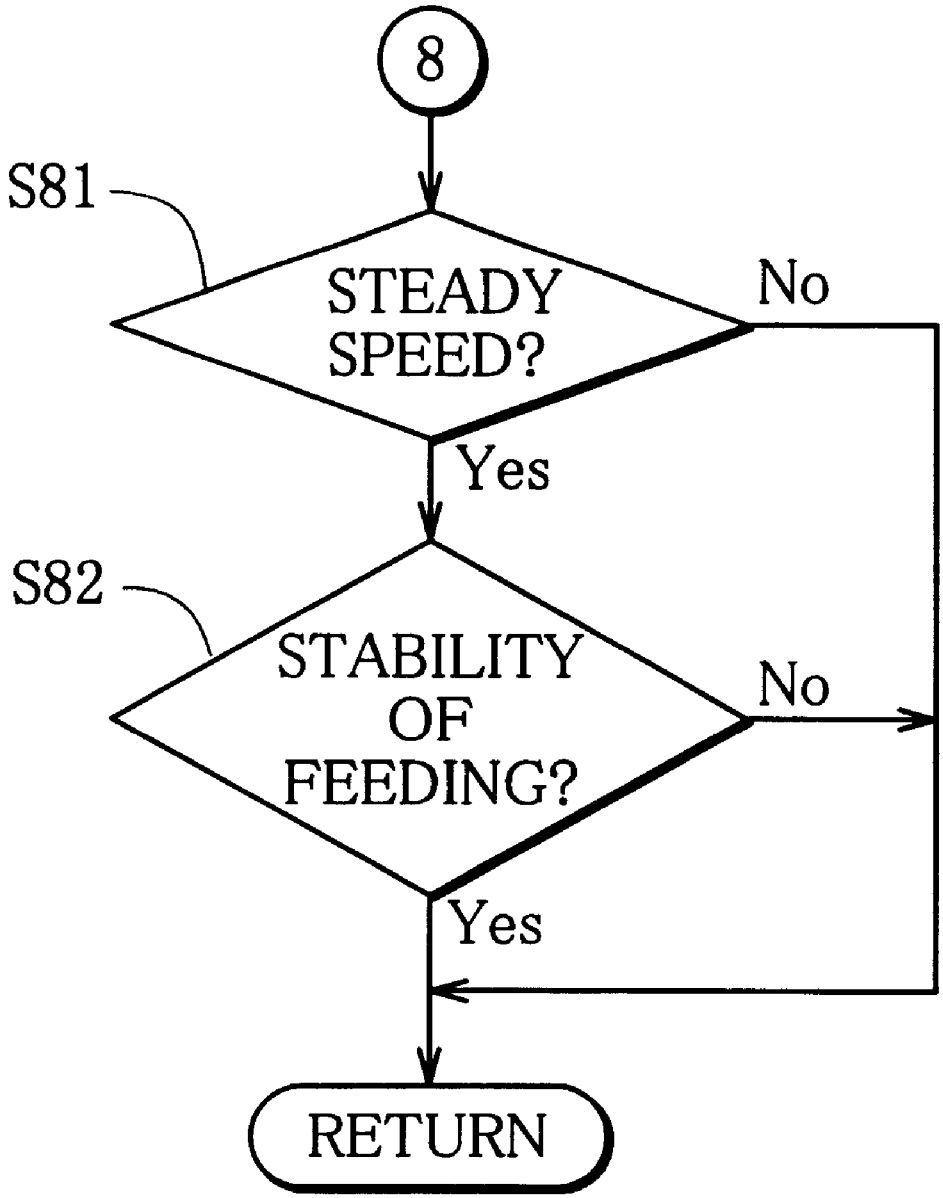

When the second acceleration mode for the packaging material F is carried out, the decision result in step S400 becomes "Yes" according to the routine in FIG. 19, and the unit 88 executes a routine shown in FIG. 27. In this routine, the unit 88 determines whether the feeding speed of the packaging material F reaches the steady speed $V_C$ (step S81). If the decision result here becomes "Yes", the unit 88 determines whether the feeding of the packaging material F is stabilized (step S82). More specifically, the unit 88 determines whether a predetermined time period $T_S$ is elapsed after the feeding speed of the packaging material F reaches the steady speed $V_C$. Here, the predetermined time $T_S$ is a minimum time required until the feeding of the packaging material F is stabilized after the feeding speed of the packaging material F reaches the steady speed $V_C$. For example, the predetermined time $T_S$ is a time between the instant when the feeding speed of the packaging material F reaches the steady speed $V_C$ and the instant when the first deceleration-timing signal is generated, and is about ⅙ of the one packing cycle period $S_P$.

When the decision result in step S82 becomes "Yes", the acceleration mode is complete. Thereafter, the above-described top seal and cut of the packaging material F are carried out, and the packing machine is returned to its steady operating condition. Here, the above-described first deceleration and the second acceleration of the packaging material F are respectively set such that length of the packaging material F fed in the deceleration mode and the acceleration mode coincides with length of one packaged product P.

The top seal and cut can be carried out only when the packaging material F is fed at the steady speed, but also during the deceleration mode for the packaging material F, i.e., during the first deceleration mode. In this case, the lowering speed of the top heat sealer 26 is controlled in accordance with the deceleration of the packaging material F.

As apparent from FIG. 17, the acceleration mode of the packaging material F is started from the time when the first acceleration-timing signal is generated, and is completed when the feeding operation of the packaging material F is brought into the steady t speed condition. Therefore, the acceleration mode is carried out during one packing cycle period $S_P$ or more. Whereas, the deceleration mode of the packaging material F is started when the first deceleration-timing signal is generated and completed until the next first deceleration-timing signal is generated, and the period of the deceleration mode is shorter than the one packing cycle period $S_P$.

On the other hand, during execution of the second acceleration mode, if the decision result in step S311 of the routine shown in FIG. 26 becomes "RESET", this means that there is a non-filling operation of the articles again immediately after the intermittent feeding process is restarted. In this case, the unit 88 determines whether the current timing is the first deceleration timing (step S341). If the decision result here becomes "Yes", the unit 88 performs the first deceleration mode for the packaging material F (step S351).

As a result, in the routine shown in FIG. 19, the decision result in step S600 becomes "Yes", and the unit 88 repeatedly carries out steps in the routine shown in FIG. 21 and subsequent routines, thereby starting the above-described deceleration mode again. The deceleration mode for the packaging material F at that time is carried out in succession to completion of the acceleration mode as shown in the one-dot line in FIG. 17. Even if "existence" and "absent" of the feeding operation of the articles are alternately appear, the feeding of the packaging material F is once accelerated to the steady speed and then, is decelerated.

When the routine shown in FIG. 22 is repeatedly carried out, i.e., when the feeding operation of the packaging material F is in a temporary suspension region in the deceleration mode, if the decision result in step S71 becomes "Yes", the unit 88 sets the reacceleration flag (step S91), and discontinues or suspends the first acceleration mode (step S92) as in the step S221 in FIG. 25. Thereafter, the unit 88 executes the step S300 in the routine of FIG. 19 as described above.

Figure 28:
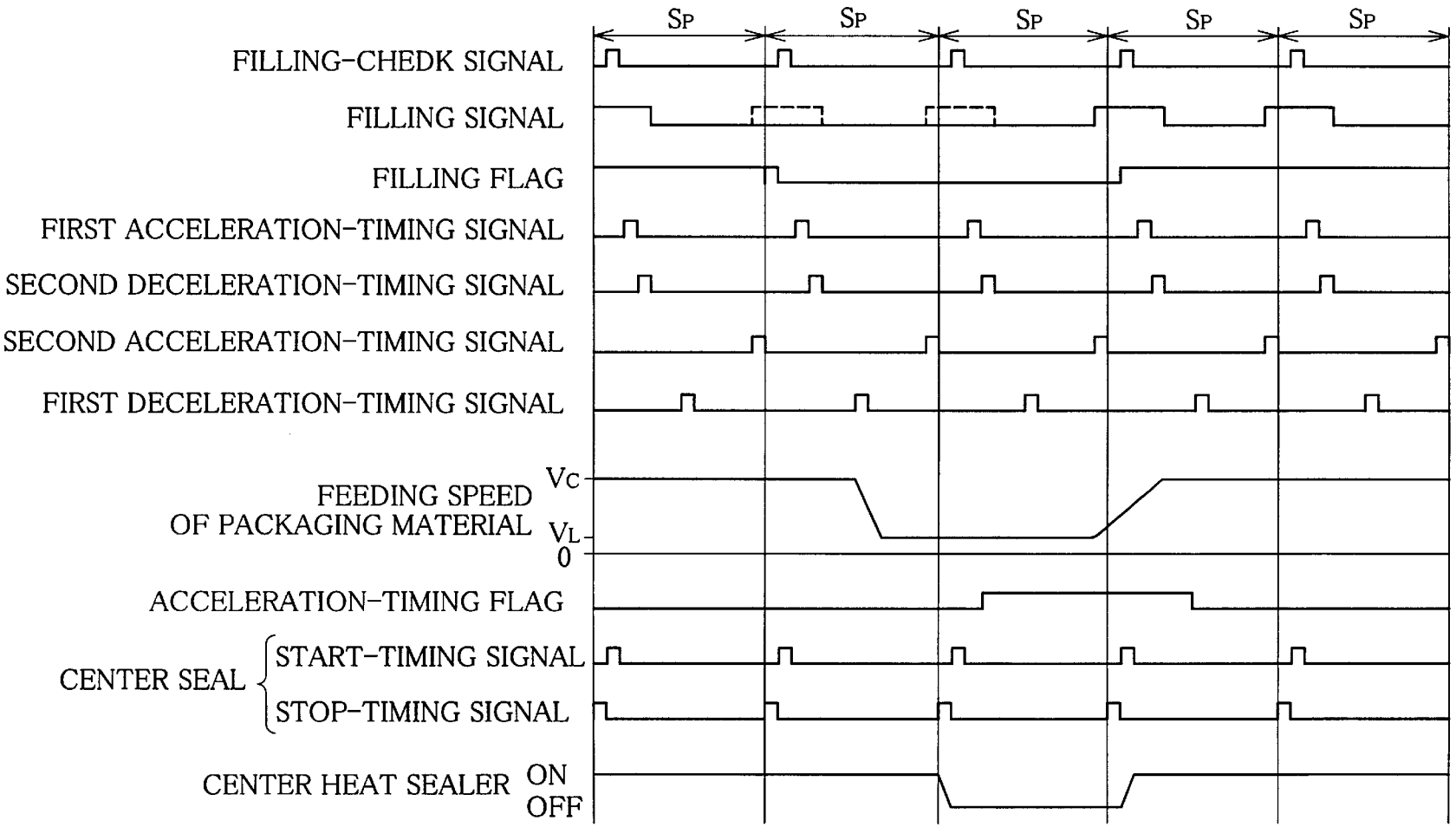
FIG. 28 is a timing chart showing a relation between a feeding state of the packaging material fed by the feed unit and the ON/OFF operation of the center heat sealer.

Here, a situation in which the decision result in step S71 is "Yes" means that the next filling operation of the articles is immediately restarted after the feeding operation of the packaging material F is shifted to the deceleration mode. In this case, the unit 88 executes the routine shown in FIG. 26 through steps S91, S92 and S300 (FIG. 17) without performing the above-described second deceleration mode (step S73). That is, as shown in FIG. 28, the feeding operation of the packaging material F is immediately shifted from the temporary suspension region in the deceleration mode to the temporary suspension region in the acceleration mode. As a result, the change over from the deceleration mode to the acceleration mode for the packaging material F is carried out without stopping the packaging material F.

When the routine shown in FIG. 26 is carried out in this manner, the decision result in step S90 becomes "SET", and the unit 88 executes the step S93 and subsequent steps. In step S93, the unit 88 determines whether the second acceleration-timing signal is generated as in step S321, i.e., whether the current timing is the second acceleration timing. At the time when the decision result here becomes "SET", the unit 88 performs the second acceleration mode for the packaging material F (step S94). In step S94, the unit 88 newly sets a second acceleration of the packaging material F, and resets the reacceleration flag (step S95). Thereafter, the unit 88 executes step S400 in FIG. 19 (see the routine in FIG. 27). Here, attention should be paid to a point that the second acceleration set in step S94 is different from the second acceleration set in step S331. That is, it is necessary to take into consideration the fact that the feeding operation of the packaging material F is continued at the speed $V_L$ between the suspension regions of the deceleration and acceleration modes and to set the second acceleration in step S94 such that feeding length of the packaging material F in the deceleration mode and the acceleration mode coincides with length of one packaged product P.

Determination Routine in Acceleration Mode

Figure 29:
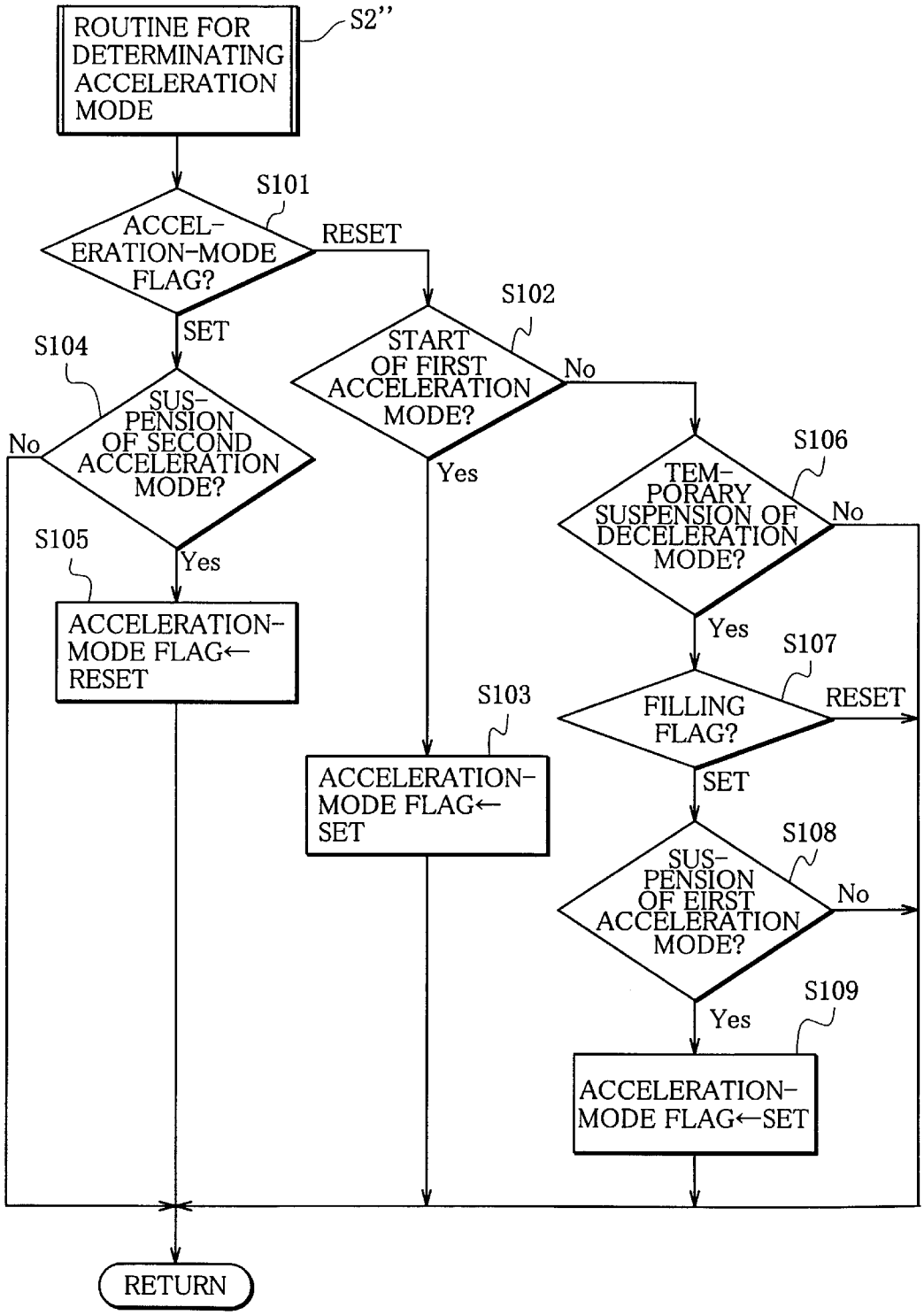
FIG. 29 is a flowchart showing details of the judging routine in FIG. 18.

FIG. 29 shows a determination routine. This determination routine is executed subsequent to the above-described control routine S2'. Here, the control-arithmetic unit 88 determines the state of an acceleration-mode flag (step S101), and when the decision result here is "RESET", the unit 88 determines whether the above-described first acceleration mode is started (step S102). When the decision result here is "Yes", the unit 88 sets the acceleration-mode flag (step S103), and this routine is completed. A situation in which the acceleration-mode flag is set in this manner means that the feeding operation of the packaging material F is shifted from the halt state to the acceleration mode as apparent from FIG. 17.

Thereafter, when the routine shown in FIG. 29 is repeatedly carried out, the decision result in step S101 becomes "SET", and the unit 88 determines whether the second acceleration mode is suspended (step S104). If the decision result here becomes "Yes", the unit 88 resets the acceleration-mode flag (step S105). Therefore, the acceleration-mode flag is set at the time when the packaging material F is fed in the acceleration mode from the halt state, and the acceleration-mode flag is reset at the time when the acceleration mode is suspended. FIGS. 17 and 28 show the situation in which the acceleration-mode flag is changed over between "SET" and "RESET" in this manner.

On the other hand, If the decision result in step S101 is "RESET" and the decision result in step S102 is "No", the acceleration mode has not yet been started. In such a state, the unit 88 determines whether the above-described deceleration mode is temporarily suspended (step S106), discriminates the state of the filling flag (step S107), and determinates whether the first acceleration mode is suspended (step S108). If any of the decision results in steps S106 to S108 is "No" or "RESET", the unit 88 completes this routine.

However, if all of the decision results in steps S106 to S108 are "Yes" or "SET", the unit 88 sets the acceleration-mode flag (step S109). If the acceleration-mode flag is set in this manner, then the above-described reacceleration flag is set in step S91 in FIG. 22, and the feeding operation of the packaging material F is directly shifted from the temporary suspension state in the deceleration mode to the temporary suspension state in the acceleration mode. Thereafter, the acceleration-mode flag is maintained in "SET" state until the acceleration mode, i.e., the second acceleration mode for the packaging material F is completed, and then the decision result in step S104 becomes "Yes".

Control Routine for Center Heat Sealer

Figure 30:
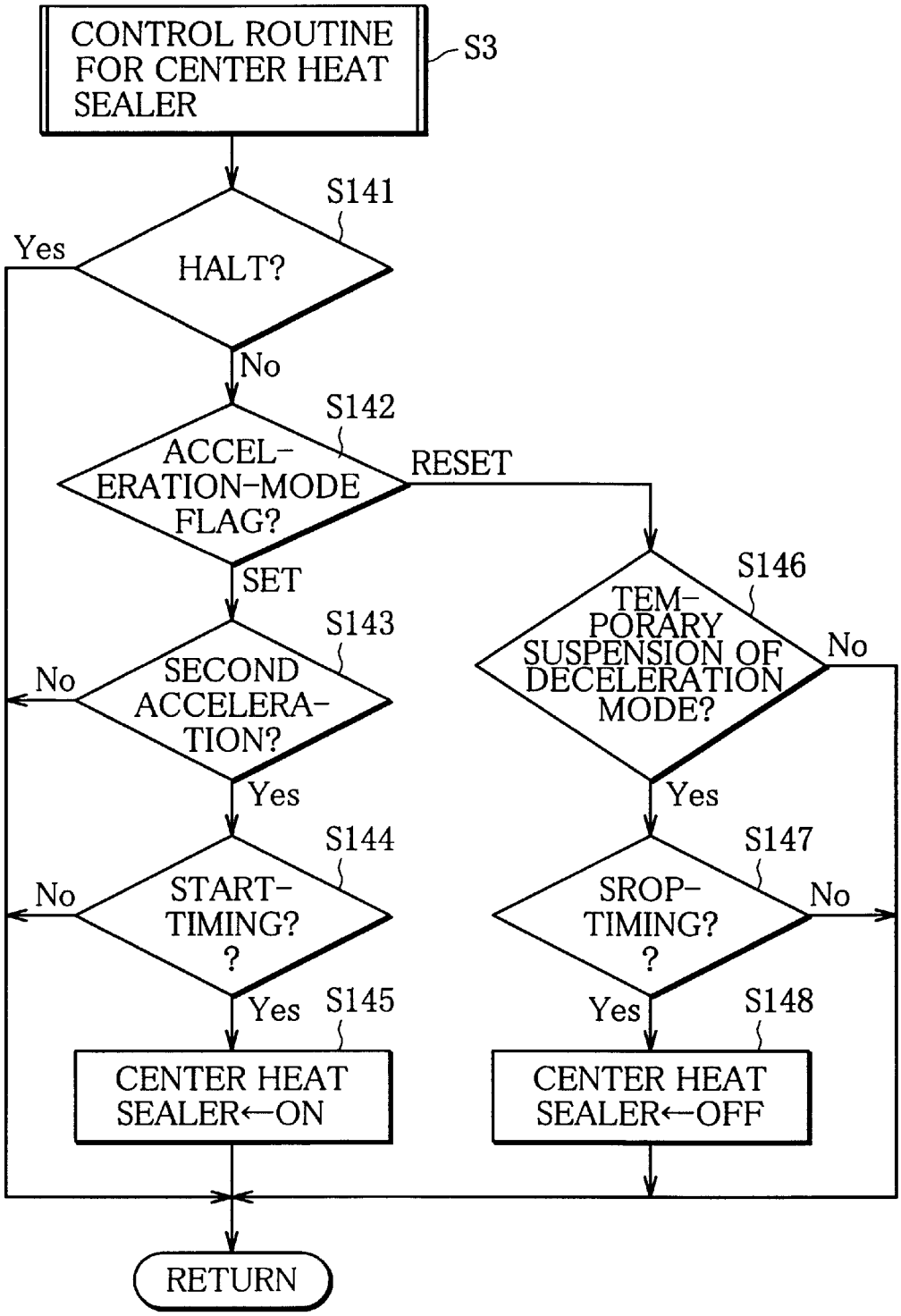
FIG. 30 is a flowchart showing the control routine for the center heat sealer.

When the above-described determination routine is completed, the unit 88 next executes a control routine S3 shown in FIG. 30. First, the unit 88 determines whether the feeding operation of the packaging material F is in the halt state (step S141). If the decision result here is "No", the feeding state of the packaging material F is any one of the steady speed feeding, the deceleration mode and the acceleration mode.

Next, the unit 88 determines the state of the acceleration-mode flag (step S142). If the decision result here is "SET", this means that the packaging material F is fed in the acceleration mode. When the feeding operation of the packaging material F is shifted to the acceleration mode through the steady speed feeding, the deceleration mode has already been carried out prior to the acceleration mode, and the center heat sealer 24 has been turned OFF in this deceleration mode as will be described later.

Thereafter, the unit 88 determines whether the feeding operation of the packaging material F is in the second acceleration mode (step S143), and determines whether the above-described start-timing signal is generated (step S144). Here, both the decision results in steps S143 and S144 are "Yes", this means that the start-timing signal has generated for the first time after the feeding operation of the packaging material F was shifted to the second acceleration mode, and at this time, the unit 88 changes over the operating state of the center heat sealer 24 from OFF to ON as shown in FIGS. 17 and 28 (step S145).

On the other hand, if the decision result in step S142 is "RESET", the unit 88 determines whether the deceleration mode is temporarily suspended (step S146), and determines whether the stop-timing signal is generated (step S147). If both the decision results in steps S146 and S147 are "Yes", this means that the stop-timing signal has generated for the first time while the feeding operation of the packaging material F is kept to be in temporarily suspension state, and at this time, the unit 88 changes over the operating state of the center heat sealer 24 from ON to OFF as shown in FIGS. 17 and 28.

In this embodiment, the center heat sealer 24 is turned OFF when the feeding operation of the packaging material F is in the deceleration mode, and more specifically, when the deceleration mode is temporarily discontinued. Further, the center heat sealer 24 is turned ON when the feeding operation of the packaging material F is in the acceleration mode, and more specifically, in the second acceleration mode.

Figure 31:
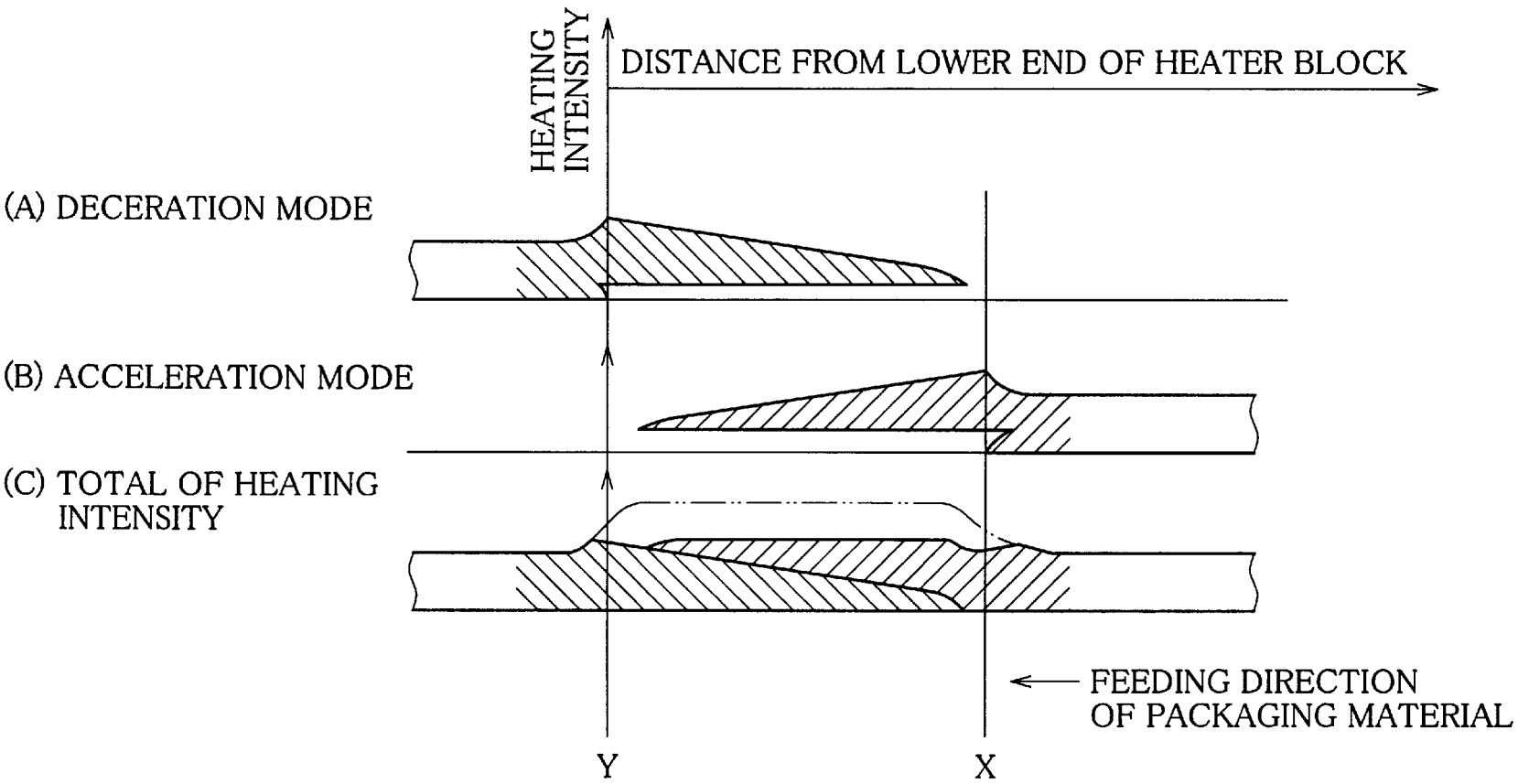
FIG. 31 is a graph showing the heating intensity that the seam of the packaging material receives when the ON/OFF operation of the center heat sealer is carried out with timing shown in FIG. 17.

When the operation of the center heat sealer 24 is changed over from ON to OFF, and from OFF to ON in the feeding state of the packaging material F shown in FIG. 17, the heating intensity that the seam of the packaging material F receives in each of the modes is shown with hatch regions in (A) and (B) in FIG. 31, and the total of the heating intensity is shown with hatch regions in (C) in FIG. 31.

Figure 32:
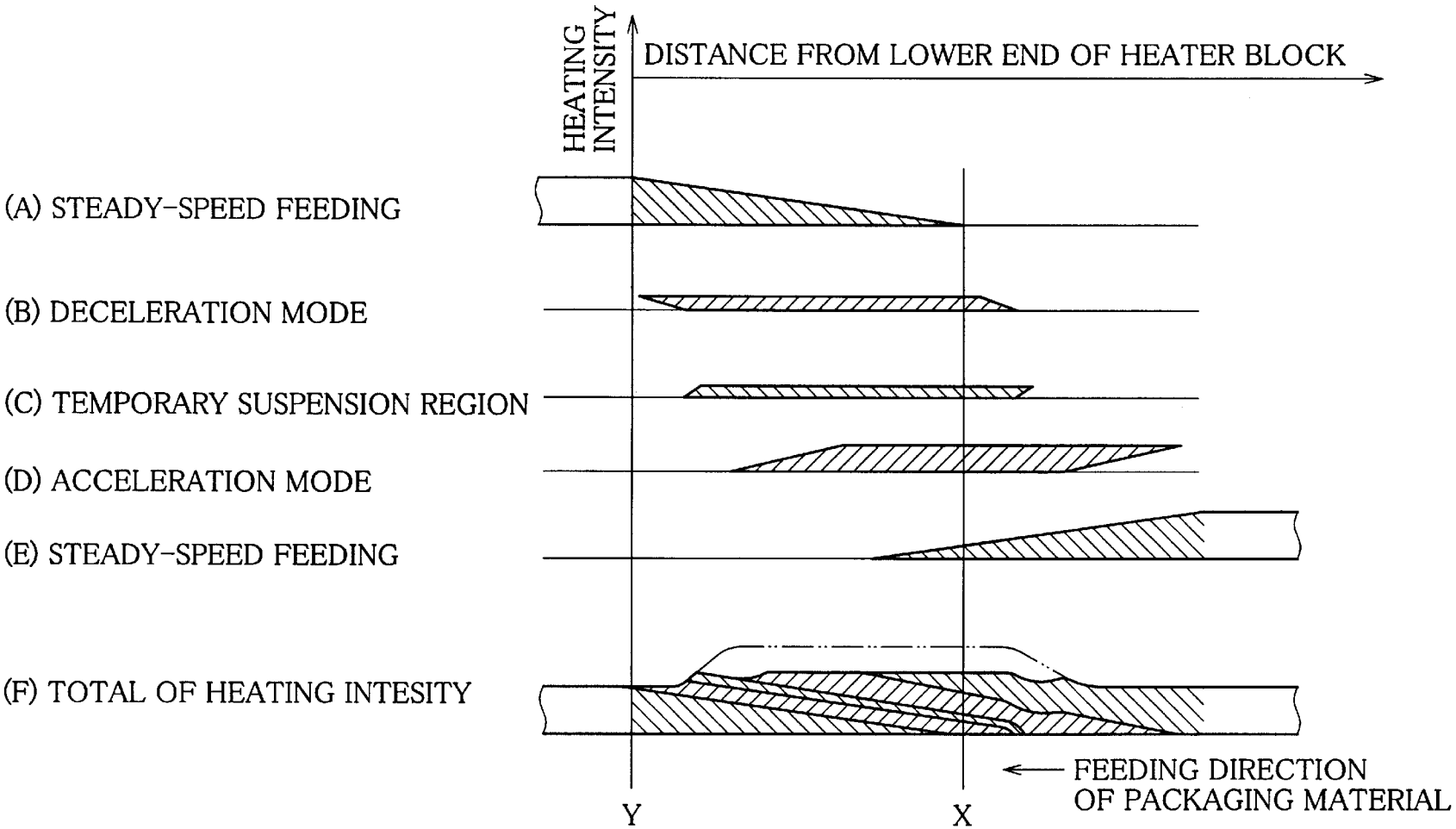
FIG. 32 is a graph showing the heating intensity that the seam of the packaging material receives when the ON/OFF operation of the center heat sealer is carried out with timing shown in FIG. 28.

On the other hand, when the operation of the center heat sealer 24 is changed over from ON to OFF, and from OFF to ON in the feeding state of the packaging material F shown in FIG. 28, the heating intensity that the seam of the packaging material F receives in each of the modes is shown with hatch regions in (A), (B), (C), (D) and (E) in FIG. 32, and the total of the heating intensity is shown with hatch regions in (F) in FIG. 32.

The two-dot line in (C) in FIG. 31 shows the total heating intensity when the center heat sealer 24 is turned OFF and ON simultaneously when the deceleration mode is completed or the acceleration mode is started. The two-dot line in (F) in FIG. 32 shows the total heating intensity when the center heat sealer 24 is maintained in its ON state during the deceleration mode and the acceleration mode. Therefore, even in the embodiments shown in FIGS. 17 and 28, it is possible to apply just enough heating intensity to the seam of the packaging material F, and to maintain the quality of an outer appearance of the packaged product P.

The invention being thus described, it will be obvious that the same may be varied in many ways. Such variations are not to be regarded as a departure from the spirit and scope of the invention, and all such modification as would be obvious to one skilled in the art are intended to be including within the scope of the following claims.

What is claimed is:

1. A vertical sealing device for a vertical type forming, filling and closing machine for flexible packages, said machine including a filling tube which guides a cylindrically formed packaging material and which is used for intermittently filling at least one article into said packaging material, the packaging material being formed such that both side edges thereof are superposed on each other so as to form a seam extending along said filling tube, said machine comprising:

detecting means for detecting a non-filling operation of the article and a restart of the filling operation of the article after the non-filling operation is detected, respectively;

a feed unit for feeding the packaging material along said filling tube, said feed unit including a constant mode for feeding the packaging material at a steady speed during a normal operating state of said machine, a deceleration mode for decelerating the packaging material from the steady speed state when said non-filling operation is detected to a low speed state, and an acceleration mode for accelerating the packaging material from said low speed state thereof to the steady speed state when said restart of the filling operation is detected;

a center heat sealer for heating and sealing the seam of the packaging material, said center heat sealer being in contact with the seam and an open position where said center heat sealer is spaced from the seam; and control means for controlling operation of each of said center heat sealer in response to the operation of said feed unit, said control means having a stop timing for moving said center heat sealer from the close position toward the open position when the operation of said feed unit is shifted from said constant mode to said deceleration mode, and a start timing for moving said center heat sealer from the open position toward the close position when the operation of said feed unit is shifted to said constant mode through said acceleration mode, and at least one of said stop timing and start timing being located within the corresponding one of said deceleration mode and acceleration mode; and wherein each of said acceleration mode and deceleration mode has a temporary suspension region for suspending the deceleration or acceleration of the packaging material so as to maintain the packaging material at a speed, respectively.

2. The device according to claim 1, wherein said stop timing is located within said deceleration mode, and the start timing is located within the acceleration mode.

3. The device according to claim 1, wherein said machine has one packing cycle time required for forming said package during the normal operating state of said machine, and a period of time of each of said acceleration mode and the deceleration mode substantially coincides with said one packing cycle.

4. The device according to claim 1, wherein said machine has one packing cycle time required for forming said package during the normal operating state of said machine, and a period of time of said acceleration mode is set equal to or longer than said one packing cycle time, and a period of time of said deceleration mode is set equal to or shorter than said one packing cycle time.

5. The device according to claim 1, wherein said feed unit feeds the packaging material at the same speed in said temporary suspension regions of said acceleration mode and deceleration mode.

6. The device according to claim 1, wherein said control means has said stop timing determined within said temporary suspension region of said deceleration mode, and has said start timing determined after termination of said temporary suspension region of said acceleration mode.

7. The device according to claim 1, wherein said feed unit continuously feeds the packaging material so as to directly shift from said temporary suspension region of said deceleration mode to said temporary suspension region of said acceleration mode when said restart of the filling operation of the article is detected immediately after the non-filling operation has been detected.

8. The device according to claim 7, wherein said control means has said stop timing determined within the temporary suspension region of said deceleration mode, and has said start timing determined after termination of said temporary suspension region of said acceleration mode.

* * * * *